United States Patent [19]

Budrean et al.

[11] Patent Number: 4,870,846

[45] Date of Patent: Oct. 3, 1989

[54] METHOD AND APPARATUS FOR EMBOSSING THE INSIDE SURFACE OF A CUP-SHAPED ARTICLE

[75] Inventors: John D. Budrean, DeMotte, Ind.; John A. Kirpatrick, Chicago Heights, Ill.

[73] Assignee: Allied Products Corporation, Chicago, Ill.

[21] Appl. No.: 168,265

[22] Filed: Mar. 15, 1988

Related U.S. Application Data

[63] Continuation-in-part of Ser. No. 29,460, Mar. 23, 1987, Pat. No. 4,785,648.

[51] Int. Cl.[4] ..... B21D 24/00

[52] U.S. Cl. ..... 72/77; 72/344; 72/354

[58] Field of Search ..... 29/159.2; 72/67, 68, 72/77, 112, 95, 96, 114, 115, 125, 253.1, 260, 265, 343, 348, 359, 344, 354

[56] References Cited

U.S. PATENT DOCUMENTS 496,601 5/1893 Edge ..... 72/77

4,339,939 7/1982 Book et al. ..... 72/348

4,509,353 4/1985 Ike et al. ..... 72/343

FOREIGN PATENT DOCUMENTS 36027 3/1980 Japan ..... 72/267

154817 8/1985 Japan ..... 72/265

355422 8/1961 Switzerland ..... 72/260

*Primary Examiner*—Lowell A. Larson

*Attorney, Agent, or Firm*—Baker, Mills & Glast

[57] ABSTRACT

A draw/emboss work station (600) of the invention includes emboss punch (594) moveable by a hydraulic system under control of a press slide (34). An emboss punch head (632) is moved downwardly into a cup-shaped article (626) to bring the article into a draw/emboss die (604). The emboss punch head (632) does not rotate while the draw die (604) does. The draw die (604) is allowed to rotate by thrust bearings (610 and 612). As the emboss punch head (632) pushes into the cup-shaped article (626) the downward rotational force is taken by the thrust bearing (612). As the emboss punch head (632) is withdrawn from the cup-shaped article (626) the upward rotational force is taken by the thrust bearing (610).

1 Claim, 13 Drawing Sheets

METHOD AND APPARATUS FOR EMBOSSING THE INSIDE SURFACE OF A CUP-SHAPED ARTICLE

RELATED APPLICATIONS

This application is a continuation-in-part of co-pending Application for U.S. Pat. Ser. No. 029,460 filed Mar. 23, 1987 and entitled "Method and Apparatus for Embossing the Inside Surface of a Cup-Shaped Article", now U.S. Pat. No. 4,785,648 granted Nov. 22, 1988.

TECHNICAL FIELD OF THE INVENTION

The present invention relates in general to methods and apparatus for forming materials, and more particularly relates to the drawing of a planar sheet of material into a cup-shaped article, and embossing the inside surface thereof.

BACKGROUND OF THE INVENTION

In the metal forming art there are numerous ways of forming cup-shaped articles. One method includes pouring a molten metal into a mold to form a cup-like shell. Another method includes forming a cylinder of sheet metal, and welding a cap to one end thereof. Yet another method includes drawing the metal from a planar sheet of metal to form the cup-shaped article. While the noted methods are all effective in forming the final article, the latter method is the most expedient, as it is less costly and requires much less time. A method of forming a cup-shaped article by the latter noted drawing process is disclosed in U.S. Pat. No. 4,509,356, and assigned to the assignee hereof.

Among other applications, cup-shaped articles are utilized in constructing fragmentation containers, such as employed in manufacturing military grenades. In this application, the inside surface of the cup-shaped article is embossed to form lines of weakness and thereby facilitate the fragmentation of the article when exploded.

Embossing a grid pattern of grooves by techniques heretofore known in the art includes the forming of the pattern while the material is flat, in either a blank or strip form. The preferred practice is to roll form the material by passing it through a pair of embossing rollers, and then rewinding the strip in a coil for subsequent processing. One of the embossing rollers is machined to impress the emboss design or pattern on one side of the metal strip, while the other roller is a smooth surface used to compress the metal strip against the embossing roller. When this technique is employed, alloy steels which form the blank or strip material tend to work-harden. Work-hardening of the material is alleviated by annealing the strip material after the roll forming of the emboss design. The annealing operation is expensive, as it is necessary to heat the embossed material to a temperature in excess of 1,000° F., under a controlled atmospheric condition. The embossed strip is then formed into the cup-shaped article by one of the methods identified above.

Other techniques for forming a grooved structure on the inside surface of a bore or cylinder concerns an extrusion process which is adapted for forming rifling grooves within a tubular structure. Such a process is briefly described in the article "Extrusion of Thin-Wall Tubes Eliminates Machining", by William G. McEwen, P. 89–90, *The Tool and Manufacturing Engineer,* December 1963. According to this process, a steel billet has a bore formed therethrough, and a mandrel, ram and ring die are utilized to extrude the billet over the mandrel and thereby form the riflings. This process is not only expensive and time consuming, but also can be accomplished only on open-ended cylindrical articles. One end of the extruded cylinder must then be welded or otherwise capped to form the cup-shaped article.

It can be seen that a need exists for a high-speed and economical method and apparatus for forming an embossed design on the inside surface of cup-shaped articles. A concomitant need exists for combining embossing and drawing operations of the material to facilitate the construction of the embossed article. An additional need exists for a high-speed drawing and embossing operation so that the forming is completed before work hardening occurs. The expensive and time-consuming annealing process can then be eliminated.

SUMMARY OF THE INVENTION

In accordance with the present invention, a method and apparatus for drawing a metal part and embossing the same in one operation is disclosed, which method and apparatus reduces or substantially eliminates the shortcomings and drawbacks associated with the prior art techniques.

In accordance with the invention, an initial drawing step comprises the use of a draw punch and an associated draw die for forming planar metal stock into a preliminary cup-shaped article. The drawn cup is then transferred to an embossing station where the cup is subjected to a further draw process and a combined embossing process, in which the sidewalls of the cup are simultaneously drawn and embossed with a design on the inside surface thereof. A final draw of the embossed cup is effective to further shape the article and form other variations in the shape of the cup.

According to an important feature of the invention, the embossing apparatus comprises a conventional punch shaft with an embossing head attached thereto. The emboss punch is disposed over an emboss die having a reduced annular part formed in the mouth of the die. A pressure sleeve surrounds the emboss punch for allowing the emboss punch to slide therein. The pressure sleeve and emboss punch operate independently to perform the combined draw and embossing operation.

The embossing step is carried out by first disposing the preliminary cup between the emboss punch and the emboss die, and then lowering the emboss punch into the cup to lower it into the emboss die in engagement with the narrowed part. When the emboss punch is lowered a predetermined amount with respect to the emboss die narrowed part, an annular opening is formed which has a width somewhat less than that of the sidewall thickness of the cup-shaped article. The emboss punch is then held stationary at the predetermined position. Next, the pressure sleeve is forced downwardly over the emboss punch so that it engages the top annular rim or shoulder of the article, thereby forcing it through the smaller annular opening and impressing the emboss design of the emboss punch onto the interior sidewall of the article. At the same time that the design is being impressed on the article sidewall, such sidewall is also reduced in thickness due to the drawing of the material through the constricted annular orifice.

In accordance with another feature of the invention, the emboss punch includes a replaceable emboss head so that a change from one embossing design to another can be quickly and efficiently made. Various emboss heads, including those of a spiral design, are disclosed to achieve different embossing patterns. When a spiral-type of embossing design is desired, the emboss punch is mounted in the station so as to be freely rotatable when the pressure sleeve forces the article through the annular orifice formed between the embossing punch head and the embossing die. For a crosshatched embossing pattern, two embossing stations are provided; one for embossing a spiral design in a first direction, and another for embossing a spiral design in a second direction to form the crosshatched pattern.

In an alternative embodiment of the invention, spiral or crosshatched embossing patterns are formed on the inside surface of the cup-shaped article by fixing the emboss punch head, while allowing the embossing die to rotate. In this manner, the cup, which undergoes a draw and embossing operation, is also allowed to rotate as it is pushed through the annular orifice.

The pressure sleeve and the embossing punch are independently driven by a common press slide which also operates the initial and final draw stations of the process. On the downward stroke of the press slide, a slave hydraulic cylinder is caused to be operated which supplies pressurized fluid to an emboss station cylinder. The emboss station cylinder operates a pivotal lever which forces the emboss punch downwardly into the cup. The pressure sleeve apparatus floats with respect to the emboss punch, and therefore is initially brought by gravity down into contact with the shoulder of the cup-shaped article. The continued downward movement of the press slide causes the hydraulic system to pivot the lever and force the emboss punch to the predetermined position, and thus the cup into the mouth of the emboss die, whereupon the lever engages with a stop. The emboss punch is held at this position which forms the annular opening with respect to the reduced diameter part of the emboss die. The continued downward motion of the press slide engages the pressure sleeve apparatus which then firmly engages the shoulder of the article and forces it downwardly through the annular opening. The sidewalls of the article thereby undergo both a drawing and an embossing of the material.

BRIEF DESCRIPTION OF THE DRAWINGS

Further features and advantages will become more apparent from the following and more particular description of the preferred embodiment of the invention, as illustrated in the accompanying drawings in which like reference characters generally refer to the same parts throughout the views, and in which.

DETAILED DESCRIPTION OF THE INVENTION

Metal Forming Work Stations

Figure 1A:
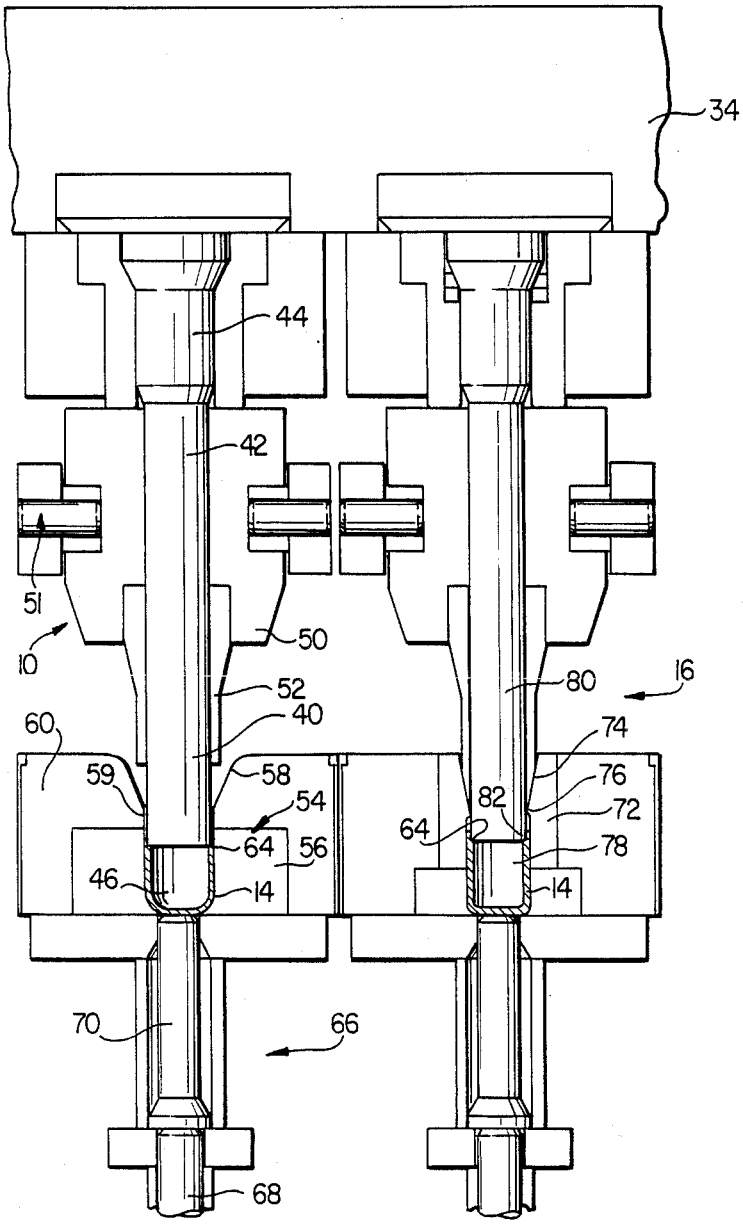
FIGS. 1*a*, 1*b* and 1*c* illustrate in simplified form the combined draw and embossing operations of the invention.
Figure 1B:
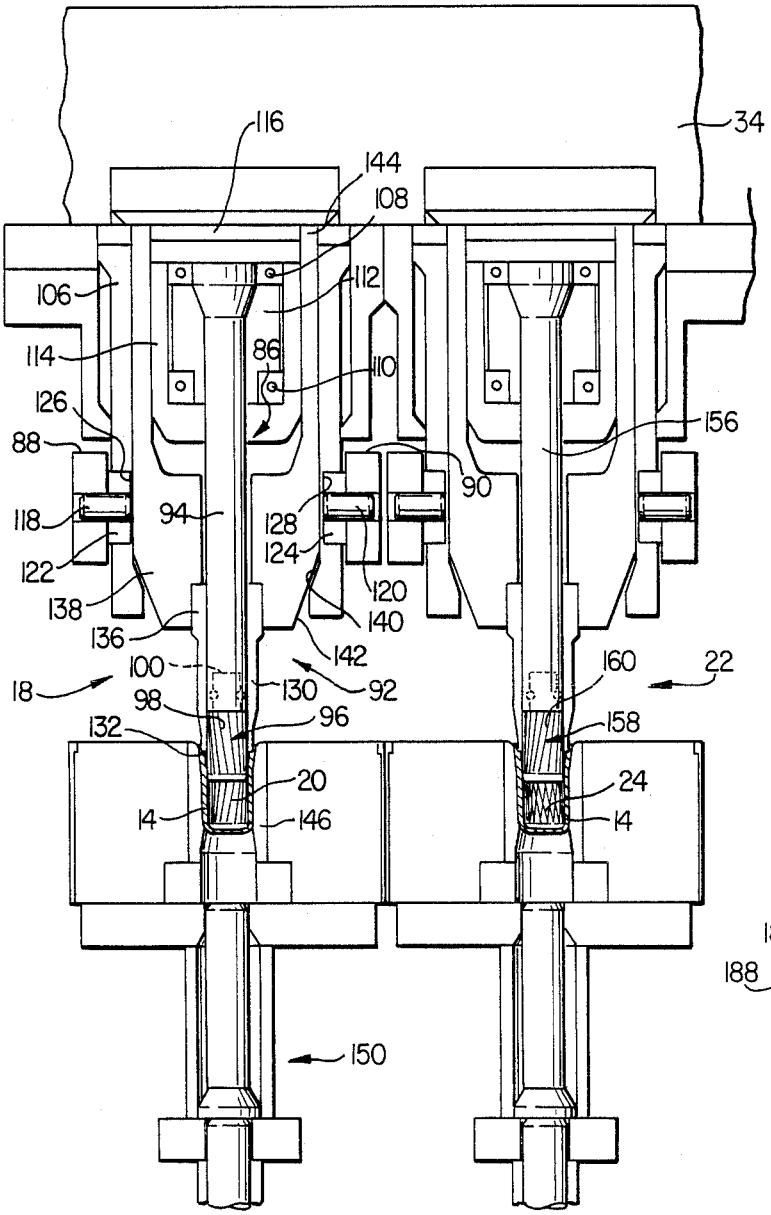
Figure 1C:
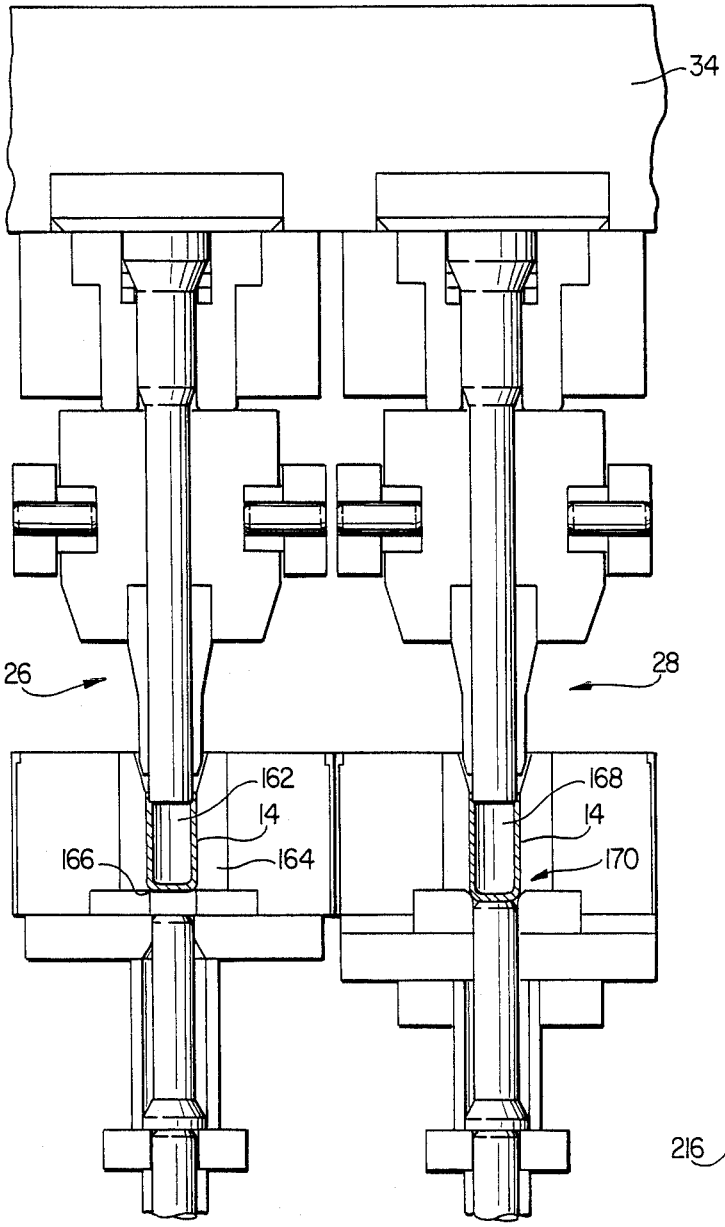

The sequential drawing and embossing steps for forming the embossed cup-shaped article of the invention are illustrated in FIGS. 1*a*–1*c*. For convenience, FIGS. 3*a*–3*f* illustrate the article after having been processed in accordance with the operations of the respective work stations of FIGS. 1*a*–1*c*. Six basic work stations are shown for fabricating metal stock from a blank to an embossed cup-shaped product. However, the invention is not to be construed as being limited to the embossing of a cup-shaped article, as cylinders can also undergo the embossing operation of the invention.

A first work station 10 takes circular planar sheet metal stock and forms the same into a preliminary cup-shaped article 14. A second draw station 16 performs a first draw of the metal cup 14, wherein the sidewalls thereof are thinned. The diametric dimensions of the cup are made smaller, and due to the extrusion of the sidewalls, the cup is lengthen somewhat, axially. A second metal work station 18 shown in FIG. 1*b* performs a further draw of the cup 14, as well as a first emboss of spirals 20 in a first direction. The next metal work station 22 performs a third drawing operation on the cup 14, and also an additional emboss 24 of a spiral design in a second direction. The first and second emboss of the inside surface of the cup 14 forms a crosshatched design. A fifth metal work station 26 shown in FIG. 1*c* performs an additional draw of the metal of the cup 14 to shape the bottom portion thereof. A last metal work station 28 performs a restrike operation on the cup 14, wherein the bottom or closed end of the cup 14 is drawn or pressed into a final shape.

While not shown, transfer apparatus is effective to automatically transfer the article from one work station to another so that the cup 14 can be sequentially processed without handling by an operator. Essentially, the transfer apparatus includes spring-loaded fingers which are adapted for engaging the outside surface of the cup 14 and moving the cup laterally to a predetermined location at the next work station so that equipment thereat can push the cup 14 out of the spring-loaded fingers and into the die apparatus. Transfer feed equipment which allows parts to be progressively moved through a multi-station die set is well known in the art, and further details thereof will not be set forth in this description.

In more detail, the press equipment of the invention includes a press slide 34 which is reciprocated vertically to synchronize the operations of each of the work stations so that the article can be processed in an orderly manner and moved from one station to the next. One reciprocating stroke of the press slide 34 is effective to perform the necessary operations on the cup 14 at each work station. The press slide reciprocates at about fifty strokes per minute. Thus, a cup 14 can be formed into a cup, drawn, and embossed in about 1.2 seconds.

The press slide 34 is moved in a reciprocating manner through a crank arm by a power source (not shown), as will be described in more detail below. Draw punches in the draw stations 10, 16, 26 and 28 are engaged by the press slide 34 for effecting the drawing of the metal cup 14 with respective cooperating draw die equipment. The combined draw and emboss stations 18 and 22, however, include a number of telescoping elements which are responsive both to the movement of the press slide 34, as well as other hydraulically operated equipment, to function in a timed manner to perform a simultaneous draw and emboss operation on the cup 14.

A number of round metal blanks are stacked in a hopper (not shown) for automatic loading to the first work station 10. After the transfer feed mechanism selects a metal blank from the load hopper, the blank is moved to the first metal work station 10. Work station 10 includes a draw punch 40 having an upper flared end 42 integral with a shaft 44. The shaft 44 is coupled to the press slide 34 so that when the press slide 34 reciprocates, the shaft 44 moves accordingly. The punch 40 is integral with the shaft 44 and is fitted with a draw head 46. Parts 40, 42, 44, and 46 comprise a one piece punch in stations for draw only. A housing 50 is guided on the punch 40 as the press slide 34 moves the punch 40 in a reciprocating manner. Importantly, the draw punch 40 and the transfer feed mechanism is constructed so that the punch 40 can move therethrough into the draw die mechanism located below the punch. A stripper sleeve 52 is fixed to a guide housing 50 for stripping the cup 14 from the punch 40 after the cup 14 has been formed and the punch 40 is moved upwardly into the transfer fingers. The stripper housing 50 is connected by a trunnion and pin arrangement to a forked lever arm 51. The lever arm is pivoted somewhat to move the stripper 52 up and down. However, when the punch 40 is moved upwardly after the forming of the cup 14, the stripper 52 is held stationary so that when the punch and attached cup 14 move upwardly, the cup is stripped off of the punch 40.

Operating in conjunction with the draw punch apparatus of metal work station 10 is draw die equipment 54. The draw die equipment 54 includes a cylindrical draw die 56 with an upper surface 58 generated inwardly toward a reduced diameter section 59 where the drawing of the metal blank occurs. Associated with the draw die 56 is a locator block 60 which is adapted for fixing the draw die 56 to a stationary table (not shown), and in vertical registry with the draw punch 40. For further details of the cup forming and drawing operations, reference is made to U.S. Pat. Nos. 4,509,356 and 4,527,413, the disclosure of which is incorporated herein by reference. As disclosed in the noted patents, a shoulder 64 is formed on the upper inside surface of the cup 14. The shoulder 64 facilitates both the drawing and embossing of the cup.

Operating in conjunction with the draw die equipment 54 is article lift-out equipment 66. In the preferred form of the invention, the lift-out equipment 66 is cam operated, including a lower shaft 68 moved by a cam (not shown) in a timed manner to lift an upper shaft 70 upwardly, thereby forcing the cup 14 out of the draw die 56. The stroke of the lift-out equipment 66 is sufficient to lift the cup 14 upwardly and into the fingers of the transfer feed device. The fingers of the transfer feed device, being spring loaded, hold the cup 14 therein for transfer to the next work station. Of course, the draw punch 40 is moved upwardly sufficiently by the press slide 34 so that it is extracted from the cup 14 by the stripper 52 and is free for lateral movement by the transfer feed mechanism.

During the metal drawing operation, the lift-out shaft 70 remains fixed as shown in FIG. 1*a* and thereby provides a bottom for the draw die 56. The lift-out shaft 70 is supported on its enlarged lower end by a support structure through which the lower shaft 68 can protrude when cammed. When the lower shaft 68 is not lifted by the cam, a clearance exists between the lift-out shaft 70 and the lower shaft 68. However, little or no compression of the material forming the bottom of the cup 14 is had between the draw punch 40 and the lift-out shaft 70. Other lift-out or eject apparatus and techniques may be utilized to remove the cup 14 from the draw die 56. Such techniques may include steel springs, air springs and gas-operated springs which provide an upwardly directed force in a timed sequence to remove the article from the draw die 56.

The first draw operation in which the sidewall of the cup 14 is drawn is carried out to metal work station 16. Station 16 is substantially identical to that of work station 10, with the exception of the draw die 72. As can be seen, draw die 72 includes a mouth 74 which is characterized with a taper less than that of the cup-forming die 56 of station 10. Draw die 72 includes an annular reduced diameter area 76 which is spaced from the outer surface of the draw punch head 78 so as to cause the metal squeezed therebetween to be thinned. As the sidewalls of the cup 14 become thinned due to the drawing operation, the cup becomes elongated in an axial direction. In comparing the cup-forming punch 40 of station 10 with the draw punch 80 of work station 16, it can be seen that the draw punch head 78 is longer than the head 46 associated with cup-forming punch 40. The drawing operation occurring at metal work station 16 is facilitated by the annular rim 82 of the punch head 78 which engages the shoulder 64 previously formed near the edge of the cup 14 in the cup-forming station 10.

In accordance with an important feature of the invention, the next metal work stations 18 and 22 function to perform a further draw of the sidewall of the cup 14, as well as impress an emboss design on the interior sidewall surface thereof. The detailed construction of the combined draw and emboss stations 18 and 22 will be described below. However, it is sufficient to understand that the metal work station 18 includes a draw punch assembly 86 which is moved primarily by the motion of yoked lever arms 88 and 90. A pressure sleeve assembly 92 is slideable with respect to the punch assembly 86 and is moved independently and indirectly by the motion of the press slide 34.

The emboss punch assembly 86 includes a punch shaft 94 with a replaceable emboss punch head 96 having a desired design 98 machined on the outer surface thereof. The emboss punch head 96 includes a stem 100 insertable into a bore formed in the lower end of the emboss punch shaft 94. Interference fit pins fix the punch head 96 within the punch shaft 94.

When it is desired to form spiral-type embossing designs within the cup 14, the punch shaft 94 is mounted for rotational movement within a punch clamp holder 106. Particularly, the top of the emboss punch shaft 94 is mounted by a pair of thrust bearings 108 and 110 within a bearing holder 112 to an upper shoe die 114. While not shown in detail in FIG. 1*b*, a retainer plate 116 is fixed to the shoe die 114, as well as to the punch clamp holder 106.

The yoked arms 88 and 90 are connected by respective pins 118 and 120 to respective trunnion blocks 122 and 124 which are adapted to slide in associated linear grooves 126 and 128 formed in opposing sides of the punch clamp holder 106. Thus, as the yoked arms 88 and 90 move up and down, the punch clamp holder 106, retainer plate 116, shoe die 114, and emboss punch shaft 94 move in like manner. It is also important to note that the yoked lever arms 88 and 90 are pivoted in a vertical manner by a hydraulic system (not shown) which functions in response to the movement of the press slide 34.

The pressure sleeve assembly 92 comprises a pressure sleeve 130 which surrounds the emboss punch shaft 94. The pressure sleeve 130 includes an annular lower edge 132 which engages the shoulder 64 previously formed in the upper inside surface of the cup 14. A number of set screws fix a base part 136 of the pressure sleeve 130 to a pressure sleeve holder 138. The pressure sleeve holder 138 is generally cylindrical in nature and dimensioned for slideable movement within the punch clamp holder 106. The punch clamp holder 106 includes an inwardly beveled surface 140 at its bottom edge thereof functioning as a stop to prevent the pressure sleeve holder 138 from moving downwardly with respect to the punch clamp holder 106 more than shown in FIG. 1*b*. The bottom exterior part of the pressure sleeve holder 138 includes an inwardly tapered surface 142 for engaging with the bevel 140 of the punch clamp holder 106.

As noted above, the pressure sleeve holder 138 can slideably move with respect to the emboss punch assembly 86. To that end, the pressure sleeve holder 138 includes an upper edge 144 which is engageable with the press slide 34 and moved under the control thereof. While not shown, the pressure sleeve holder 138 includes a pair of grooves formed in opposing sidewalls thereof for accommodating the pins which connect the emboss punch shaft 94 indirectly from the upper shoe die 114 to the punch clamp holder 106.

The metal work station 18 further includes a draw die 146 which includes an annular inside reduced diameter protuberance which functions with the emboss punch head 96 to simultaneously draw the sidewall material of the cup 14 and emboss the inside surface thereof. The draw die 146 is held stationary with respect to the platform by a number of fasteners (not shown). A lift-out mechanism 150 functions in a timed manner, similar to that of lift-out equipment 66 of station 10, to assist in the removal of the cup 14 from the draw die 146.

Figure 2A:
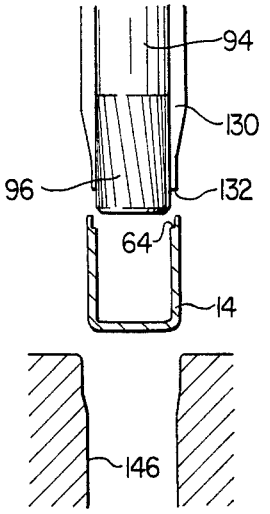
FIGS. 2*a* through 2*i* illustrate the cup-shaped article as it undergoes the combined drawing and embossing operation of the invention.
Figure 2B:
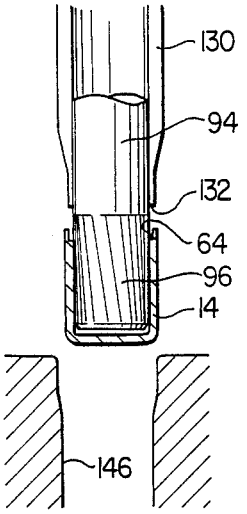

The simplified operation of the draw/emboss work station 18 functions as follows. Reference to FIGS. 2*a*–2*i* in conjunction with FIG. 1*b* is made to facilitate the understanding of the operation performed by the draw/emboss station 18. The initial position of the apparatus of the invention is such that the press slide 34 is in its uppermost position, with the emboss punch assembly 86 and the pressure sleeve assembly 92 also retracted to an uppermost position. The transfer feed mechanism is then activated to move the cup 14 in a position aligned between the emboss punch head 96 and the emboss die 146. This is illustrated in FIG. 2*a*, which also shows the emboss punch head 96 withdrawn in the pressure sleeve 130.

In the next step of the operation, downward movement of the press slide 34 causes the hydraulic system to move the yoked lever arms 88 and 90 and move the emboss punch assembly 86 downwardly. As noted in FIG. 2*b*, the emboss punch head 96 enters the cup 14 which is held by the spring-loaded fingers of the transfer feed mechanism. At this point in the draw/emboss operation, the pressure sleeve assembly 92 is free-floating, and thus rides in a slideable manner with the emboss punch assembly 86. Accordingly, when the marginal edge 132 of the pressure sleeve 130 contacts the shoulder 64 of the cup 14, the downward motion of the pressure sleeve 130 is temporarily stalled. However, the punch head 96 continues to move into the cup 14 until the punch head 96 bottoms out therein.

Figure 2C:
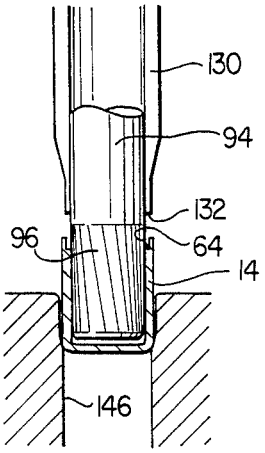

FIG. 2*c* illustrates the next position of the draw embossing step in which the emboss punch head 96 has forced the cup 14 downwardly out of engagement with the fingers of the transfer feed mechanism. Before the cup 14 becomes completely disengaged from the transfer feed mechanism, it has entered the mouth of the emboss die 146, thereby remaining under directional control of the system. The pressure sleeve 130 continues to ride engaged with the cup shoulder 64 while the punch head 96 continues to drive the cup 14 into the emboss die 146. It should be noted that at this point in the operation, no drawing or embossing of the metal has yet taken place with regard to metal work station 18.

Figure 2D:
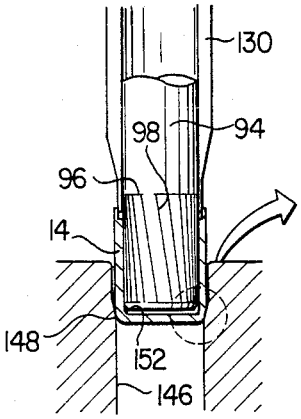
Figure 2E:
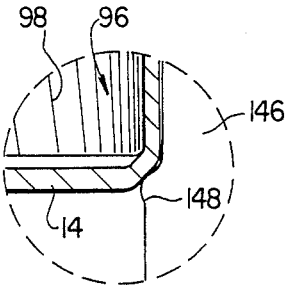
Figure 2F:
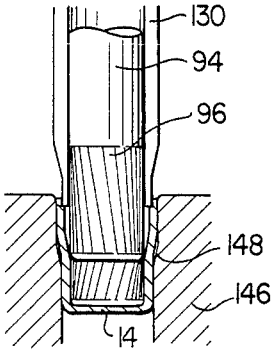

FIG. 2*d* illustrates the position of the emboss punch head 96 which has not yet bottomed out in its downward travel. The emboss punch travel is shown stalled because hydraulic cylinder force on the lever is insufficient to drive the part into the emboss die 146 which is smaller in diameter than the part. The press slide 34 contacts the upper edge 144 (FIG. 1*b*) and drives the part through the draw/emboss die 146. The emboss punch travels downward with the part until stops on lever halt further downward movement of emboss punch 96. The downward position of the emboss punch assembly 86 is limited by a stop mechanism (not shown) which prevents further downward motion of the yoked lever arms 88 and 90. In its bottom-most position, as shown in FIG. 2*f*, the corner edge 152 of the emboss punch head 96 is spaced a predetermined distance from the internal reduced diameter part 148 of the emboss die 146. The distance between the emboss punch 96 and the reduced diameter part 148 of the emboss die defines an annular opening or orifice which defines a space which is smaller than the width of the cup sidewall. While the emboss punch head 96 is held stationary with respect to the emboss die 146, it is free to rotate during the draw and emboss operation. The rotational feature of the punch 94 is important in forming spiral-type of embossing designs.

The area of the annular space defined by the predetermined position of the emboss punch head 96 and the internal reduced diameter part 148 is calculated to equal the area of the cylindrical portion of the cup minus the area of the grooves 98 in the punch head, plus the area of the protruding embossed ridge formed on the internal surface of the cup 14. While not shown in FIG. 2*e*, the bottom corner of the cup 14 is pinched between the punch head corner 152 and reduced diameter die part 148, and thus the draw operation is started.

Continuing with the draw/emboss operation, it should be noted that while the emboss punch assembly 86 remains fixed in the noted position to form the annular orifice, the continued downward movement of the press slide 34 engages the top edge 144 of the pressure sleeve holder 138, whereupon the pressure sleeve 130 ceases to ride in a floating manner in engagement with the cup shoulder 64. Rather, under the force of the press slide 34, the pressure sleeve holder 138, and thus the pressure sleeve 130, is forced downwardly. As noted in FIG. 2*f*, the pressure sleeve 130 applies a downward force on the cup shoulder 64, thereby forcing the cup 14 off the emboss punch head 96 and forced through the annular orifice. Because of the reduction in the width of the cup sidewall which occurs when the cup 14 is forced through the annular opening, the pattern of the embossing grooves 98 is impressed on the internal sidewall of the cup 14. The transfer of the emboss impression from the emboss punch head 96 to the internal cup sidewall occurs simultaneously with the thinning or drawing of the sidewall material occasioned by the cup 14 being forced through the annular opening. Also, when embossing a spiral design on the inside surface of the cup 14, the emboss punch shaft 94 and head 96 are rotated by the cup as its sidewall is pressed through the annular opening.

It is important to realize that with the foregoing method and apparatus, the embossed design can be formed substantially over the entire interior surface of the vertical sidewall of the cup 14, starting at the corner of the cup where the bottom joins the sidewall.

Figure 2G:
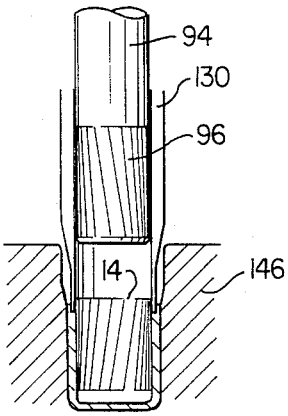

FIG. 2*g* depicts the cup 14 within the emboss die 146 after it has been fully drawn and embossed in station 18. The press slide 34 reaches the bottom of its stroke and its direction of movement is then reversed, whereupon it begins to move upwardly bringing the emboss punch head 96 upwardly also. In response to the initial upward movement of the press slide 34, pressure in the hydraulic system which controls the yoked lever arms 88 and 90 is released, and the yoked arms are also begin to move upwardly. The upward movement of the yoked lever arm 88 and 90 causes the emboss punch assembly 86 to also move upwardly, as noted in FIG. 2*g*. However, the pressure sleeve assembly 92, not being rigidly fixed to the press slide 34, does not move upwardly in unison therewith, and the force of gravity maintains the pressure sleeve 130 engaged with the cup shoulder 64. The cup 14 thus remains in the emboss die 146 so that the emboss punch head 96 can be withdrawn from the cup 14.

Figure 2H:
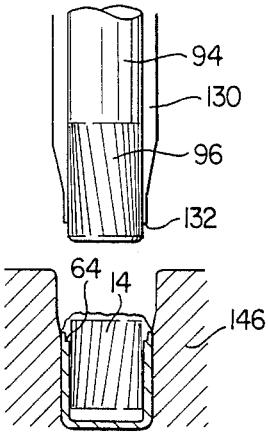

With regard to FIG. 2*h*, as the press slide 34 continues its upward movement, the emboss punch assembly 86 and thus the punch clamp holder 106 also move upwardly. The upward movement of the punch clamp holder 106 continues until the internal beveled edge 140 comes into engagement with the tapered edge 142 of the pressure sleeve holder 138. Upon engagement of these beveled and tapered surfaces, the continued upward movement of the punch clamp holder 106 also lifts the pressure sleeve holder 138 upwardly. The emboss punch assembly 86 and the pressure sleeve assembly 92 then move upwardly in unison together until such elements are clear of the spring-loaded fingers of the transfer feed mechanism.

Figure 2I:
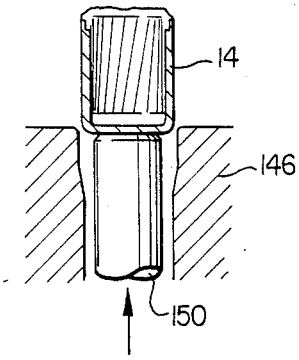

FIG. 2*i* illustrates the final step of the combined draw/emboss operation in which the lift-out shaft assembly 150 forces the drawn and embossed cup 14 upwardly out of the emboss die 146 and into engagement with the transfer feed mechanism. The transfer feed mechanism is then triggered so that the emboss cup 14 can be moved to the next metal work station. As noted from the foregoing sequence of steps, the combined draw and emboss step is carried out n one stroke of the press slide 34. Furthermore, the emboss apparatus is constructed to function with the apparatus used in forming and drawing the cup 14.

It should be understood from the foregoing that the emboss punch head 96 can include any of a number of emboss patterns, some of which will be described in more detail below. As noted in FIG. 1*b*, the draw/emboss station 18 is shown equipped with an emboss punch head 96 having a diagonal or spiral-type of design. In the event it is desired to emboss another spiral design to form a cross-hatched pattern, then a second draw/emboss station 22 is utilized. Such a second draw/emboss station 22 would also be utilized to form a crosshatched, checkerboard or intersecting diagonal type of pattern. However, in the event only a single nonintersecting embossing pattern is desired, than only a single draw/emboss station 18 would be required.

With regard to the second draw/emboss station 22, the emboss punch shaft 156 is equipped with an emboss punch head 158 which includes a diagonal pattern 160 that is arranged opposite that of the emboss pattern 98 of the emboss punch assembly 86 associated with station 18. The result of the dual embossing stations is the cross-hatched pattern 24. In all other respects, the second draw/emboss station 22 is substantially identical in function and construction to draw/emboss station 18.

The metal forming process of the invention includes an additional metal work station 26 which performs a further draw and formation of the cup 14. Draw station 26 is substantially identical to draw station 16, except for variations of the draw head 162 and the draw die 164. In essence, the draw operation occurring in metal work station 26 further thins the upper nonembossed sidewall of the cup 14, in addition to providing a desired shape along the bottom corner 166 of the cup 14. FIG. 3*e* shows the open end of the cup 14 reduced in diameter over that of the cup of FIG. 3*d*. As noted in FIG. 1*c*, the punch head 162 and draw die 164 include mating stepped portions which form a corresponding stepped groove around the bottom of the cup 14.

Metal work station 28 is provided with draw punch equipment 168 and draw die apparatus 170 which performs a further draw of the open end of the cup 14. According to this operation, the bottom of the cup 14 is also further formed to achieve a desired shape.

Figure 3A:
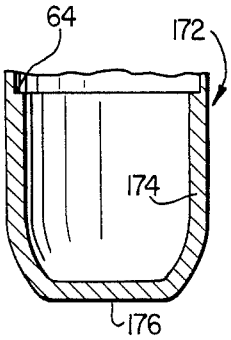
FIGS. 3*a* through 3*f* are sectional views of the cup-shaped article as it is formed in accordance with the operations of the metal forming stations of FIGS. 1*a*, 1*b* and 1*c;*
Figure 3B:
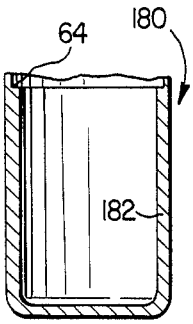
Figure 3C:
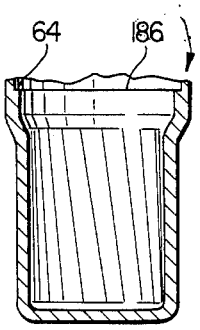
Figure 3D:
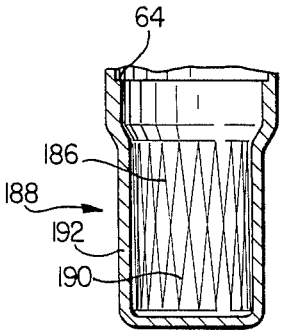
Figure 3E:
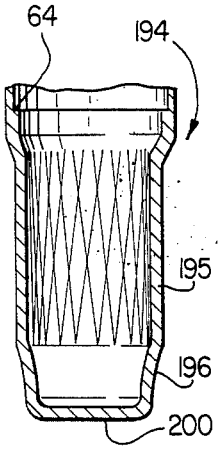

FIGS. 3*a*–3*f* depicts the details of the cup 14 as it progresses through the processing of the six work stations described above. However, it should be understood that the number of draw stations varies with the part size and material, and thus those skilled in the art may utilize more or fewer work stations than described above. FIG. 3*a* illustrates a cup 172 after having been formed according to the operations of metal work station 10. The cup 172 includes a cylindrical sidewall 174 and a bottom 176. Shown also is a shoulder 64 which is utilized in subsequent steps to facilitate the drawing and embossing of the cup 172. For purposes of example, the cup 172 may include a nominal diameter of about 1.95 inches, and a nominal height of about 1.99 inches.

FIG. 3*b* illustrates a cup 180 after having been processed according to the operations of metal work station 16. Due to the reduction in the outside and inside diameter of the cup 14 the axial length of the cup 180 is lengthened by about 0.27 inches and narrowed axially by about 0.23 inches.

FIG. 3*c* illustrates a cup 184 after having been processed according to the operations of the draw/emboss work station 18. Most notably, the cup 184 includes a diagonal design 186 on its interior surface. Due to the internal embossing operation, the axial length of the cup 184 is not extended, however the nominal diameter has been reduced about 0.07 inch. Again, the shoulder 64 is utilized to force the cup 184 between an annular opening defined by the space between the emboss punch head 96 and a reduced diameter part of the emboss die 146.

FIG. 3*d* illustrates the result of a second emboss and draw operation performed according to the second draw/emboss station 22. The resultant embossed cup 88 includes a second spiral pattern 190 which, together with the previously embossed spiral pattern 186, forms a diamond-shaped pattern on the inside surface of the cup 88. The draw operation performed at work station 22 further reduces the inside and outside diameter of the cup.

FIG. 3*e* illustrates a cup 194 after a draw operation performed by metal work station 26. The cup 194 is shown further elongated due to diametric reduction. The draw punch 162 and draw die 164 of station 26 are constructed to form a tapered transition 196 between the sidewall 195 and the bottom 200 of the cup 194. The embossed pattern 202 is not substantially affected by this draw operation.

Figure 3F:
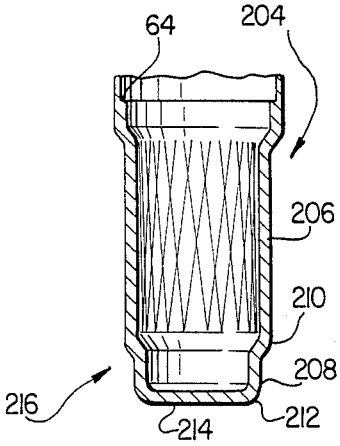

FIG. 3*f* illustrates a cup 204 formed pursuant to the operations of metal work station 28. As can be seen, the cup 204 includes a cylindrical sidewall 206 forming a major part of the cup 204, and a shorter and narrower sidewall section 208 formed at the bottom of the cup 204. In the final operation, the enlarged open end of the cup is drawn to the same diameter as the sidewall section 206, thus producing a straight wall cup 204. Metal transition area 210 joins the major sidewall section 206 to the minor sidewall section 208, and metal transition area 212 joins the minor sidewall section 208 to the cup bottom 214. The major sidewall section 206 of the cup 204 is not further thinned by the operation of metal work station 28. However, the stepped sidewall 216 is further defined by the work station 28 to form a cup having a desired shape.

As noted above in connection with FIG. 1*b*, various embossing designs can be achieved by fixing to the emboss punch shaft 94 a head having the appropriate design. The replaceable nature of the punch head 96 enhances the versatility of the operation so that different embossing designs can be formed by simply changing the emboss punch head 96.

Emboss Punch Heads

Figure 4A:
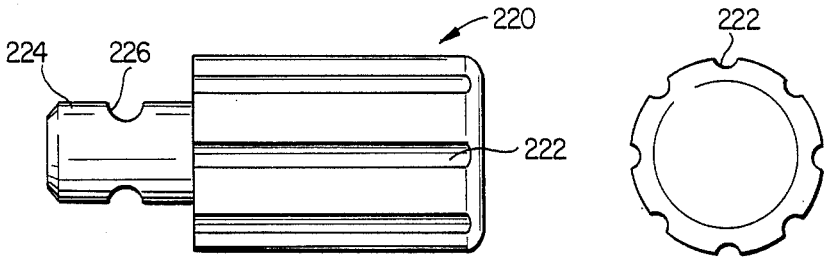
FIGS. 4*a* through 4*h* are respective side and bottom views of a number of punch heads having various embossing designs.

FIGS. 4*a*–4*h* illustrate various embossing patterns which can be machined on the outer face of different emboss punch heads. Particularly, FIG. 4*a* illustrates an emboss head 220 having a symmetrical pattern of semicircular indentions 222 formed around the outer cylindrical surface of the head. The punch head 220 includes a stem 224 with a transverse linear groove 226 formed on opposing sides thereof for fixing the head 220 to a punch head shaft 94. Fixing the punch head 220 to the punch shaft in this manner prevents respective rotational movement between these parts.

Figure 4B:
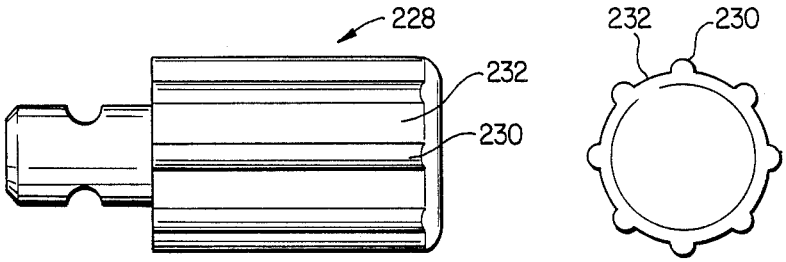

FIG. 4*b* depicts a punch head 228 which includes a symmetrical pattern of semicircular protrusions 230 formed on the outer cylindrical surface 232 of the punch head 228.

Figure 4C:
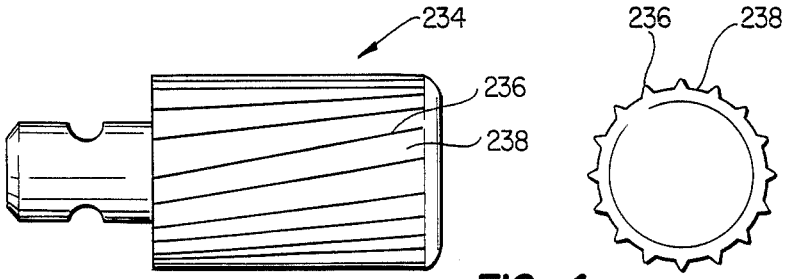

FIG. 4*c* shows an embossed punch head 234 which is characterized by a symmetrical pattern of V-shaped protrusions 236 which extend outwardly from the cylindrical surface 238. The V-shaped protrusions 236 spiral partially around the circumference of the emboss punch head 234, from one end to the other. Various other numbers of protrusions 236 and/or pitches thereof may be utilized to suit particular purposes. In order to emboss a crosshatch design on the inside surface of a tubular member, another emboss punch head (not shown) can be formed which includes outwardly directed protrusions similar to that of the emboss punch head 234, but spiraling in an opposite direction.

Figure 4D:
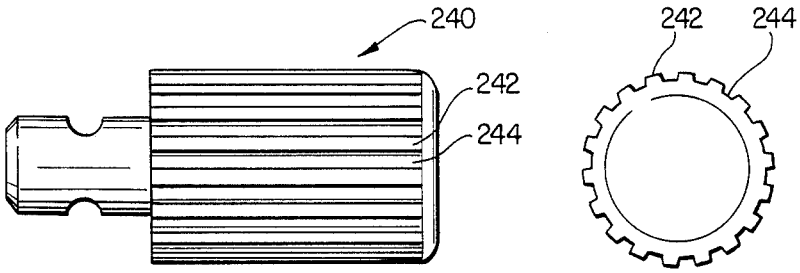

FIG. 4*d* depicts yet another emboss punch head 40 which is characterized by a symmetrical pattern adapted for forming a vertically splined design. Particularly, the emboss punch head 240 has machined within a cylindrical surface 242 generally square indented areas 244. The width of the areas 242 and 244 are substantially identical so that the raised areas and depressed areas impressed within the inside surfaces of a cylindrical article are of substantially the same width.

Figure 4E:
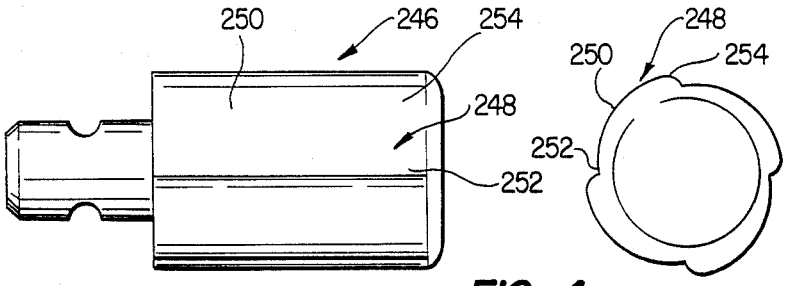

FIG. 4*e* illustrates an emboss punch head 246 having a number of lobes 248 each with an arcuate surface 250 beginning with a minimum distance 252 from the axis of the emboss punch head 246 to a maximum distance 254 therefrom. The lobes 248 are divided into quadrants around the emboss punch head 246, but of course, various other numbers and shapes of lobes can be utilized.

Figure 4F:
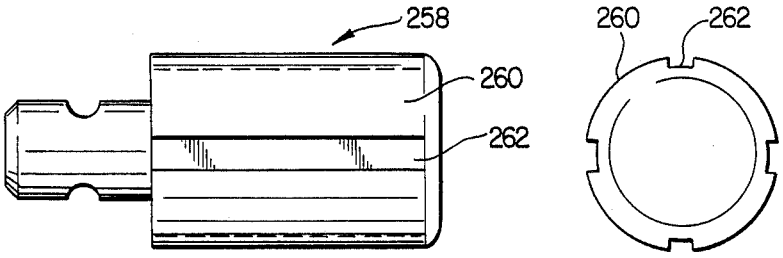

FIG. 4*f* shows an emboss punch head 258 having an outer cylindrical surface 260 with a number of square indented areas 262 formed therein.

Figure 4G:
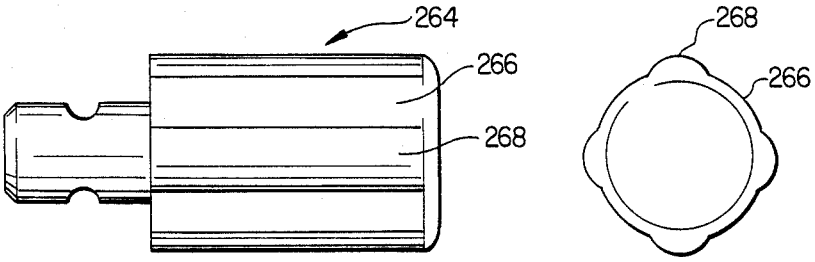

FIG. 4*g* illustrates yet another emboss punch head 264 having a generally cylindrical exterior surface 266 with smaller radius circular areas 268 projecting therefrom.

Figure 4H:
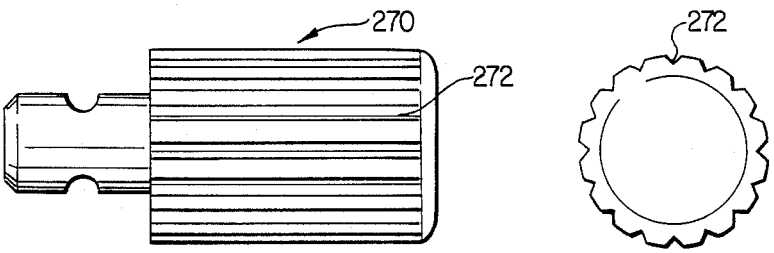

FIG. 4*h* depicts an emboss punch head 270 with V-groove indentations 272 formed symmetrically around the outer circumference of the punch head 270.

The emboss punch heads described above depict examples of designs which can be impressed within a cup. It should be understood that any of the linear or vertically oriented patterns could be formed in a helical or diagonal, or a right-hand or left-hand pattern.

As noted above, the annular orifice formed by the space between the emboss punch head 96 and the emboss die 146 is related to the type of emboss pattern impressed on the inside surface of the cup 14. The area of the annular orifice is calculated to equal the area of the cylindrical portion of the cup after the draw, minus the area of the grooves, plus the area of the protuberances to be embossed. Hence, depending upon the type of emboss pattern utilized, the size of the emboss punch head and/or the placement thereof with respect to the internal reduced diameter part of the emboss die should be considered.

Emboss Punch and Pressure Sleeve Assemblies

Figure 5:
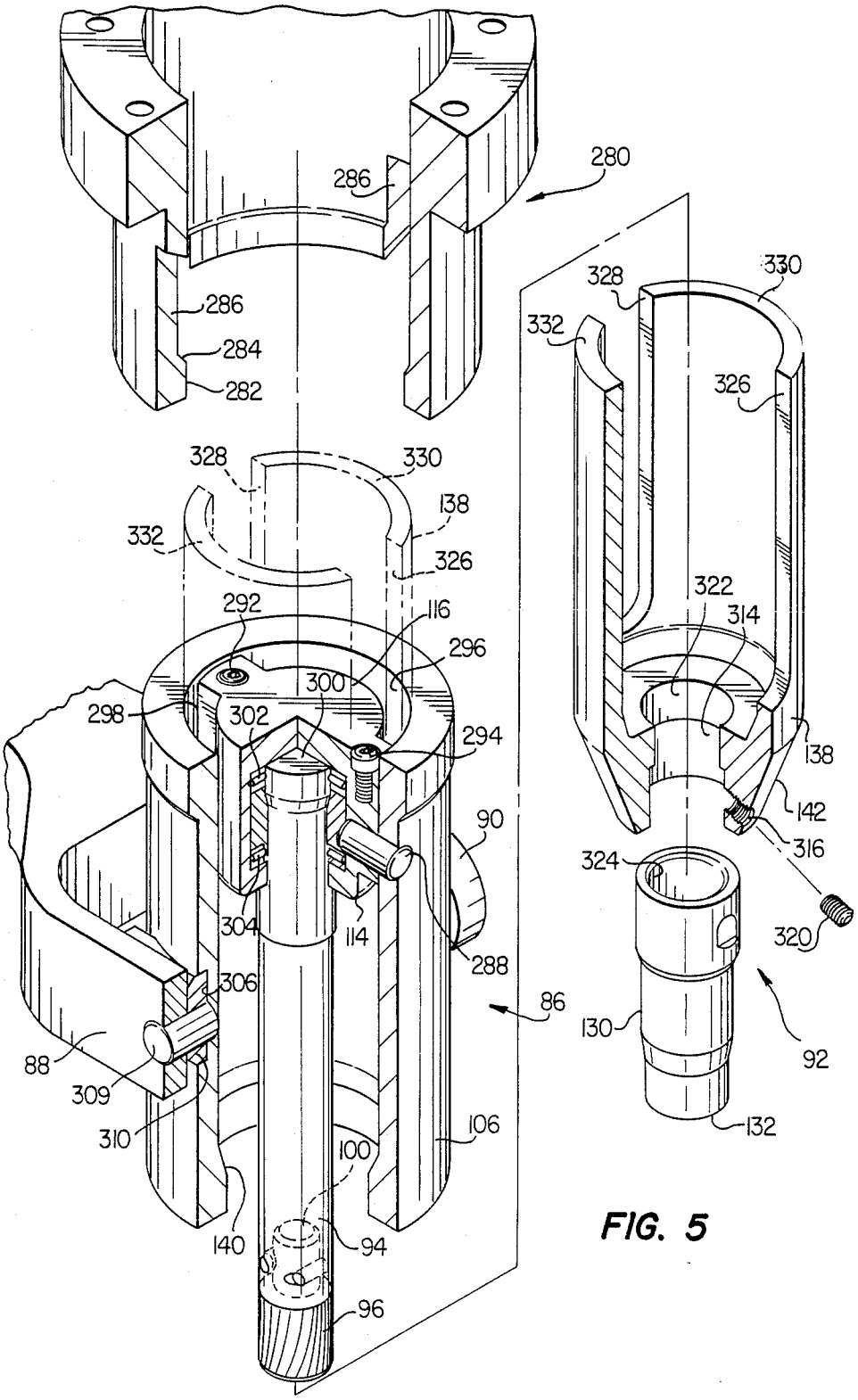
FIG. 5 illustrates in exploded form the component parts of the emboss punch and pressure sleeve assemblies.

The details of the emboss punch assembly and the pressure sleeve assembly are shown in more detail, in exploded form, in FIG. 5. A guide housing 280, comprising a part of the press slide 34 shown in FIG. 1*b*, is also illustrated. The press slide guide housing 280 is cylindrical in nature, including an internal inwardly directed edge 282. The edge 282 includes a tapered surface 284 which functions as a stop that limits the downward movement of the emboss punch assembly 86. Also, the guide housing 280 includes a rather large opening 286 in opposing sidewall surfaces thereof to accommodate the movement of apparatus which connects the yoked lever arms 88 and 90 to the emboss punch assembly 86.

The emboss punch assembly 86 includes the punch clamp holder 106 connected by a pair of pins 288 to the upper die shoe 114. The pins 288 are press fit into both the punch clamp holder 106 and the upper shoe die 114 to fix the elements together. The retainer plate 116 is fastened to the upper shoe die 114 by a pair of fastening screws 292 and 294. The retainer plate 116 does not completely cover the cylindrical opening within the punch clamp holder 106, but rather is constructed to define a pair of openings 296 and 298. The emboss punch shaft 94 includes an upper end 300 which abuts with the undersurface of the retainer plate 116. The emboss punch shaft 94 is also fixed within the upper shoe die 114 by an upper thrust bearing 302 and a lower thrust bearing 304. With this construction, the emboss punch shaft 94 is free to rotate about its axial axis, but is fixed to the punch clamp holder 106 for following reciprocating movements therewith. Formed on opposing outer sidewalls of the punch clamp holder 106 are recessed channels 306 and 308 (FIGS. 6 and 7) to accommodate the sliding action of a corresponding pair of trunnion slider blocks 310 and 312. The trunnion blocks 310 and 312 are fixed to the respective yoked lever arms 88 and 90 by bearing pins 309 and 311.

Continuing with FIG. 5, there is illustrated the pressure sleeve assembly 92. The pressure sleeve assembly 92 includes the pressure sleeve holder 138 and the pressure sleeve 130. The pressure sleeve holder 138 is generally cylindrical in form, including a lower end which has an external inwardly directed sidewall 140 which engages the internal marginal tapered edge 142 of the punch clamp holder 106. The pressure sleeve holder 138 includes at its lower end thereof a bore 314 for receiving therein the pressure sleeve 130. A pair of threaded holes 316 are provided for securing the pressure sleeve 130 within the bore 314 by a pair of fastening screws 320. The pressure sleeve holder 138 also includes a smaller diameter bore 322 which is coaxially aligned with a bore 324 formed through the pressure sleeve 130. Thus, when the pressure sleeve 130 is fixed within the pressure sleeve holder 138, the emboss punch shaft 94 can slide through the minor diameter bore 322 and also through the bore 324 within the pressure sleeve holder 130.

A pair of open-ended grooves 326 and 328 are formed in the pressure sleeve holder 138 for allowing movement thereof about the punch clamp holder pins 288 and 290. The open-ended grooves 326 and 328 are formed so as to extend from about the middle of the pressure sleeve holder 138 to the upper end thereof.

The pressure sleeve holder 138, constructed in accordance with the foregoing, defines a partial semicircular extension 330 and a second semicircular extension 332, which extend through the respective semicircular openings 296 and 298 located atop the emboss punch assembly 86. The pressure sleeve holder extensions 330 and 332 are constructed with a length such that when the bottom tapered surface 140 of the pressure sleeve holder 138 engages the tapered marginal edge 142 of the punch clamp holder 106, the top surfaces of the pressure sleeve holder extensions 330 and 332 extend a short distance beyond the top surface of the punch clamp holder 106. The diametric size of the pressure sleeve holder 138 is selected to be somewhat less than the internal diameter of the punch clamp holder 106 so as to allow free slideable movement between the elements.

In assembling the draw/emboss station 18, the pressure sleeve holder 138 is inserted into the punch clamp holder 106 before the retainer plate 116, associated apparatus, and emboss punch shaft 94 are affixed thereto by the pins 288 and 290. After assembling in such manner, the pressure sleeve holder 138 is captured within the punch clamp holder 106, but allowed to move independently with respect to the punch clamp holder 106. Indeed, the force applied to the pressure sleeve holder 138 arises from the contact of the semicircular extensions 330 and 332 with the press slide 34. Thus, when the press slide 34 is in a raised position, the pressure sleeve holder 138 is not in contact with the press slide, but rather moves with the motion of the punch clamp holder 106 by gravity, through the engagement of the beveled surface 142 and the tapered surface 140. However, and as noted above in connection with FIG. 1*b*, when the bottom annular edge 132 of the pressure sleeve 130 becomes engaged with the shoulder 64 of the cup 14, the movement of the pressure sleeve holder 138 is stalled, even though the punch clamp holder 106 continues to move the emboss punch head 96 further into the cup 14.

Figure 6:
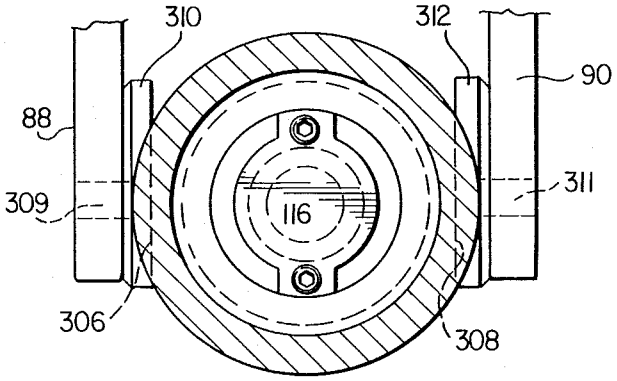
FIG. 6 is a top view of the punch clamp holder apparatus.
Figure 7:
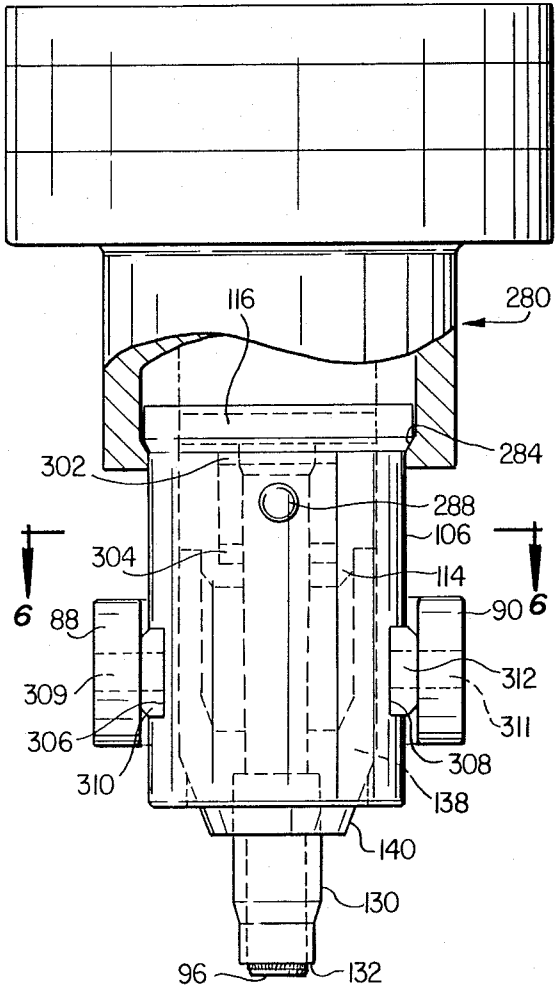
FIG. 7 illustrates a side view of the punch clamp holder, with the lever arm attachment thereto.

With reference now to FIGS. 6 and 7, there is illustrated the manner in which the punch clamp holder 106 is moved under the force of the yoked lever arms 88 and 90. Vertical pivotal movement of the Yoked lever arms 88 and 90 is translated to vertical movement of the punch clamp holder 106 by a pair trunnion slider blocks 310 and 312. The trunnion slider blocks 310 and 312 are mounted for slideable movement within the exterior recessed channels 306 and 308 of the punch clamp holder 106. Further, the trunnion slider blocks 310 and 312 are mounted for rotational movement about respective pins 309 and 311 which, in turn, are fixed within the yoked lever arms 88 and 90. Thus, as the ends of the lever arms 88 and 90 pivot about an arcuate path, the trunnion slider blocks 310 and 312 force the punch clamp holder 106 in a linear direction along a vertical path while the slider blocks 310 and 312 move within the respective recessed channels 306 and 308.

It can be appreciated that the punch clamp holder 106, and thus the emboss punch shaft 94 and head 96 are moved in response to the movement cf the yoked lever arms. Importantly, the pressure sleeve assembly 92 is adapted to float with the movements of the emboss punch assembly 86 with two exceptions. First, and as noted above, when the lower annular edge 132 of the pressure sleeve 130 initially contacts the shoulder 64 of the cup 14, the movement of the pressure sleeve assembly 92 is stalled. Secondly, when the press slide 34 moves a predetermined distance downwardly, an engagement therewith is made with the pressure sleeve holder extensions 330 and 332, whereupon the pressure sleeve assembly 92 is forced downwardly, thereby forcing the cup 14 through the annular opening, as noted above.

Draw/Emboss Work Station Operation

Figure 8:
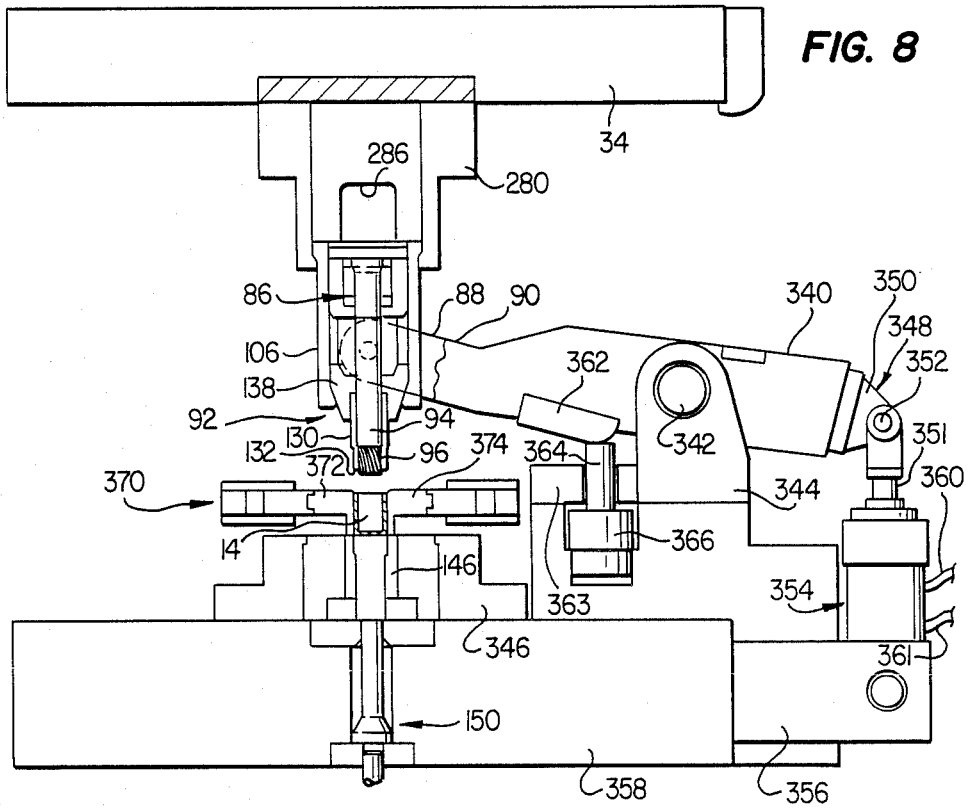
FIGS. 8–11 depict the apparatus of the invention in various positions during the combined draw and embossing operation.

FIG. 8 is a side view of the metal work station 18 which is adapted to perform simultaneous draw and embossing operations on the cup 14. The apparatus of the draw/emboss work station 18 is shown at a "top of stroke" sequence of the operation, in which the pressure slide 34 is at its uppermost position and the forked lever arms 88 and 90 are also at their uppermost pivoted position. Apparatus of the draw/emboss station shown in FIG. 8 further includes a lever 340 which is fixed for pivotal movement by a pin 342 about a lever support base 344. The lever support base 344 is fixed with respect to the draw/emboss die holder 346. The lever 340 is constructed with the yoked lever arms 88 and 90, as described above. Fixed to the other end of the lever 340 is a bracket 348 to which a clevis 350 is fixed. The clevis 350 is, in turn, fixed to the plunger end of a hydraulic cylinder 354 by a pin 352. The cylinder part of the hydraulic cylinder 354 is fixed by a heavy-duty bracket 356 to the lower die shoe 358. Pressurized hydraulic fluid is supplied to the cylinder 354 by a high-pressure hoses 360 and 361.

Fixed to the lever 340 is a block 362 which is engageable with the end of a push rod 364 which is part of a compressed gas cylinder 366. The block can be moved along with the lever 340 until the block 362 abuts with stop member 363. The gas cylinder 366 is fixed with respect to the lower die shoe 358, and is of the type which exerts a continuous pressure on the push rod 364, tending to force the push rod 364 outwardly. When the push rod 364 is near the bottom of its stroke, it is retracted into the cylinder 366. The block 362 abuts with the stop 353, thereby limiting the further downward movement of the yoked lever arms 88 and 90.

Downward movement of the emboss punch assembly 86 through the lever 340 is effected by supplying pressurized hydraulic fluid through hose 361 to the hydraulic cylinder 354. The piston 351 is thereby forced outwardly and, through the clevis 350, the lever bracket 348 is forced upwardly. The lever 340 thus pivots about the pin 342 and forces the yoked lever arms 88 and 90 downwardly. The downward movement of the yoked lever arms 88 and 90 continues as the block 362 engages the top of the extended gas cylinder push rod 364, but stops when the block 362 abuts with stop member 363. The block 362 is adjustable with respect to the lever 340 so that the downward movement of the yoked lever arms 88 and 90 can be arrested at a predetermined position. Particularly, the block 362 is adjusted so that the downward movement of the yoked lever arms 88 and 90 are arrested when the lower portion of the emboss punch head 96 is located with respect to the draw/emboss die 146 so as to form the annular orifice described above.

The rate of movement of the lever 340 is controlled by the volume of fluid applied to the cylinders 354. The application of fluid pressure to cylinder 354 is indirectly controlled by the motion of the press slide 34, through a hydraulic system to be discussed in more detail below. However, it is important to realize that once the pressure has been released from the hydraulic cylinder 354, the gas cylinder 366 is effective to apply an upward pressure to the block 362 and raise the yoked lever arms 88 and 90.

Additional apparatus associated with the various work stations comprises the transfer feed mechanism 370. Forming a part of the transfer feed mechanism are spring-loaded finger devices 372 and 374 for holding the cup 14 in engagement when transferring it from one work station to another. The transfer feed mechanism 370 is also adapted to hold the cup 14 in a stationary location above the draw/emboss die 146 so that the emboss punch head 96 can force the cup 14 through the spring-loaded fingers 372 and 374 and into the draw/emboss die 146. After the emboss punch has forced the cup 14 partially into the draw/emboss die 146 the transfer feed starts its return stroke, causing the spring closed fingers to open momentarily (part is engaged in the die and emboss punch is engaged in the part movement of transfer feed causes fingers to open). As the transfer feed returns to its starting position the pressure sleeve and emboss punch is still going through the working stroke and are still in the part with the part in the die. The returning fingers snap around the pressure sleeve and wait for the ejector to raise part into the fingers. Also, the spring-loaded fingers 372 and 374 are shaped so that when the lift-out anvil mechanism 150 forces the cup 14 out of the draw/emboss die 146, the cup 14 can is forced upwardly back into engagement between the fingers 372 and 374.

FIG. 8 further illustrates that in the "top of stroke" position, the punch clamp holder 106 is in its lower-most position with respect to the guide housing 280, and the pressure sleeve holder 138 is in its lower-most position with respect to the punch clamp holder 106. When positioned as such, the emboss punch head 96 extends downwardly, slightly beyond the bottom annular edge 132 of the pressure sleeve 130.

Figure 9:
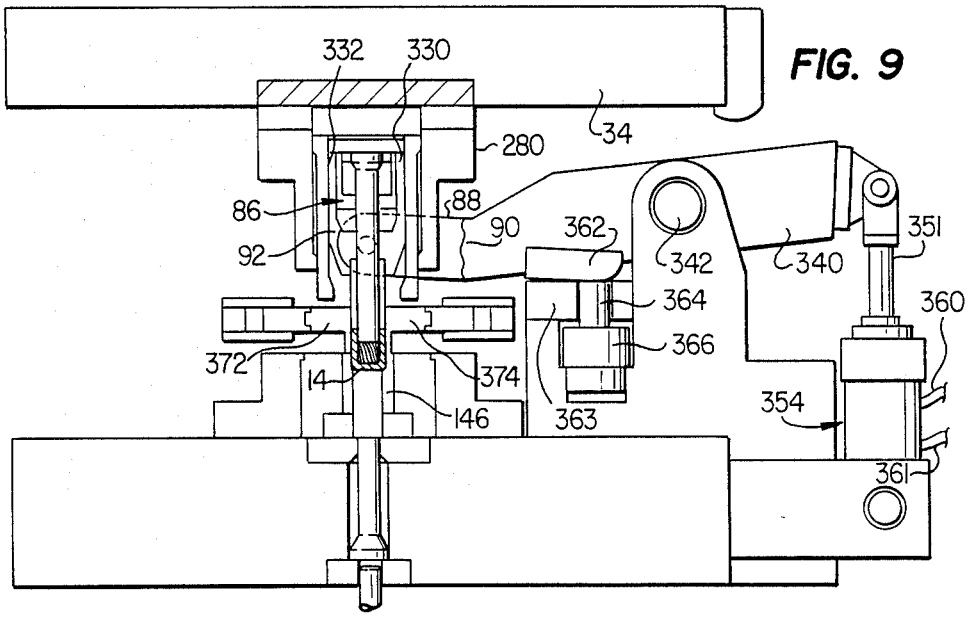

FIG. 9 illustrates another positional arrangement of the draw/emboss station apparatus 18 occurring subsequent to that shown in FIG. 8. Specifically, FIG. 9 shows the piston 351 extended from the hydraulic cylinder 354, thereby pivoting the lever 340 to a position where the block 362 is abutted against the stop member 363, and further downward movement thereof is prevented. It is important to understand that before the block 362 is forced against the stop member 363, the hydraulic cylinder 354 stalls out. However, as the pressure sleeve 92 pushes part 14 into the draw/emboss die 146, the force maintained in the hydraulic cylinders causes lever 340 to move an additional small distance and force the block 362 in contact with stop member 363.

When hydraulic cylinder 354 stalls out the fluid displaced by slave cylinder 400 is dumped over the relief 428 (FIG. 12), as will be described more fully below. At the position noted in FIG. 9, the emboss punch head 96 has pushed the cup 14 out of engagement with the transfer feed mechanism fingers 372 and 374 and partially into the draw/emboss die 146. At this position, the lower annular edge of the emboss punch head 96 is spaced a predetermined distance from the reduced diameter part of the draw/emboss die 146, thereby forming the annular opening.

During the lowering of the emboss punch assembly 86, the weight of the pressure sleeve assembly 92 has also allowed it to be lowered until the lower annular edge 132 of the pressure sleeve 130 is resting in engagement with the shoulder 64 of the cup 14. During the pivotal movement of the lever 340 occasioned by the hydraulic cylinder 354, the press slide 34 is also lowered. The anvil part of the guide housing 280 is shown in contact with the semicircular extensions 330 and 332 of the pressure sleeve holder 138. The next sequence to be executed in the draw/emboss step is the forcing of the cup 14 through the annular opening by the forced downward movement of the pressure sleeve apparatus 92.

Figure 10:
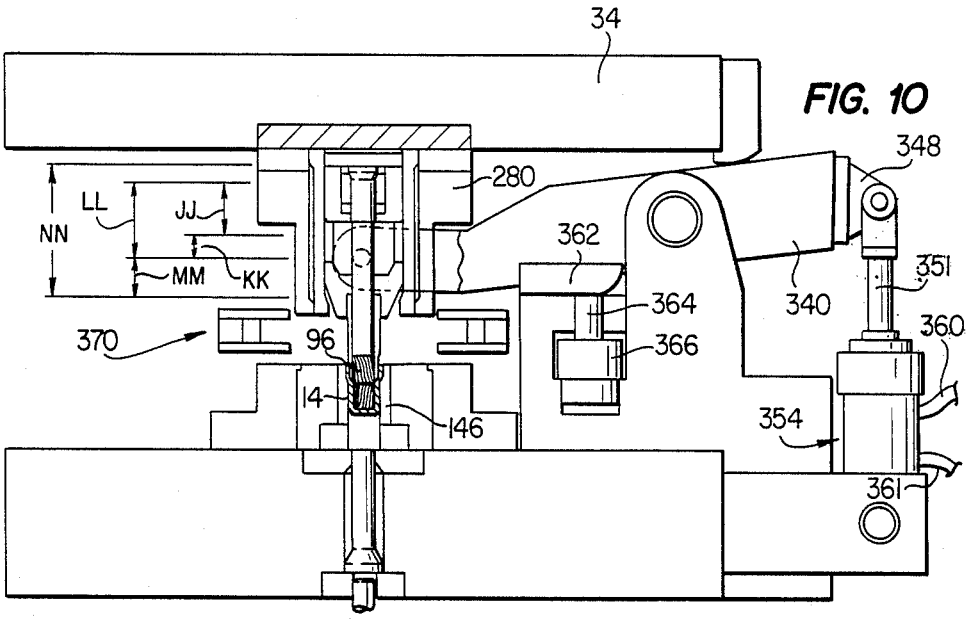

FIG. 10 is another depiction of the draw/emboss station apparatus 18, showing the elements thereof at their lower-most positions, and with the draw and embossing operations fully completed on the cup 14. It can be seen that the movement of the lever 340 has not changed from that shown in FIG. 9, and thus the emboss punch head, with respect to the die 146, remains stationary during the emboss process. However, the press slide 34, and thus the guide housing anvil, have forced the pressure sleeve apparatus 92 downwardly. As a result, the pressure sleeve 130 applies a force on the shoulder 64 of the cup 14, forcing it through the annular orifice. Because the distance between the emboss punch head 96 and the reduced diameter part of the draw/emboss die 146 is somewhat smaller than the diameter of previously drawn cup 14, the cup material is drawn to a smaller nominal diameter. At the same time the embossing design of the emboss punch head 96 is impressed within the inside sidewall of the cup 14.

Also illustrated in FIG. 10 are various dimensional designations which identify the distances various elements of the draw/emboss station 18 travel. Distance JJ identifies the initial movement of the emboss punch assembly 86 due to the operation of the hydraulic cylinder 354. Distance KK identifies the distance in which the die shoe 114 travels together with pressure sleeve 130, and pushes the cup 14 into the die 146 until halted by the engagement of the block 362 with the abutting stop block 363. Distance LL represents the combined distance of JJ and KK. Distance MM identifies the distance in which the pressure sleeve apparatus 92 travels downwardly under the force of the press slide 34. Essentially, distance MM represents the distance by which the cup 14 is forced through the annular opening. Distance identified by NN is the total free vertical movement of the press slide 34.

Figure 11:
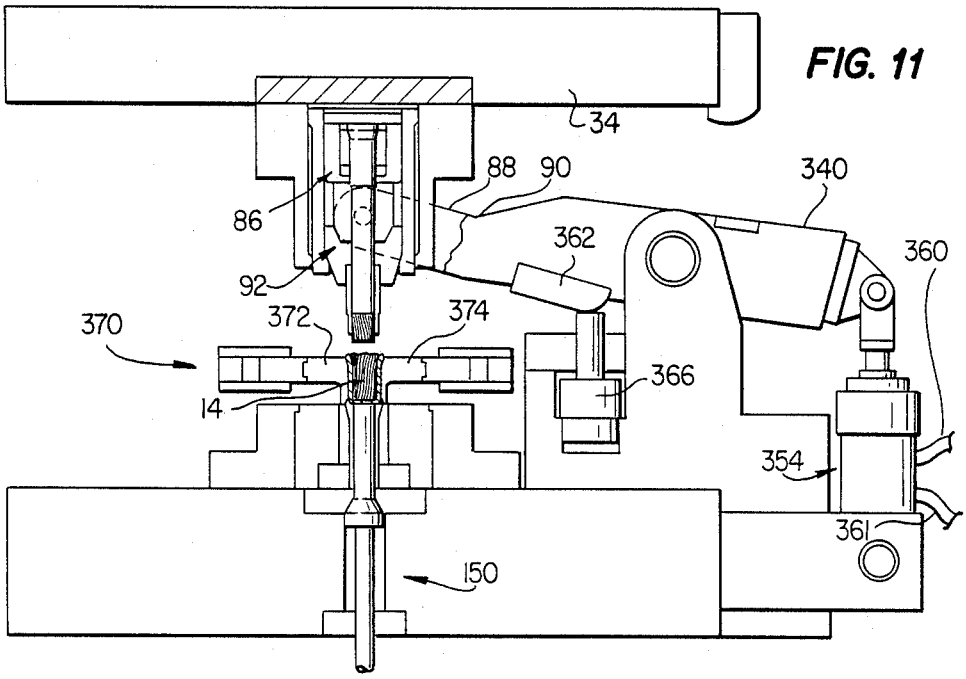

FIG. 11 illustrates the lift-out part of the draw and embossing sequence of the invention. The press slide 34 is shown moved to its upper-most position. As noted above, the upward movement of the press slide 34 allows the hydraulic system to relieve the pressure applied to the hydraulic cylinder 354, thereby allowing the gas cylinder 366 to force the yoked lever arms 88 and 90 upwardly. Thus, when the press slide 34 begins its upward movement, the yoked lever arms 88 and 90 also move upwardly in unison therewith. The lift-out anvil 150 is also activated, and moved upwardly to force the drawn and embossed cup 14 out of the die 146 and back into engagement with the spring-loaded fingers 372 and 374. The processed cup 14 is thus ready to be transferred to the subsequent work station where additional drawing and/or embossing of the cup 14 may occur. Also, the emboss punch apparatus 86 and the pressure sleeve apparatus 92 are in their fully raised position, ready for another cup to be moved into position for drawing and embossing.

Hydraulic System

Figure 12:
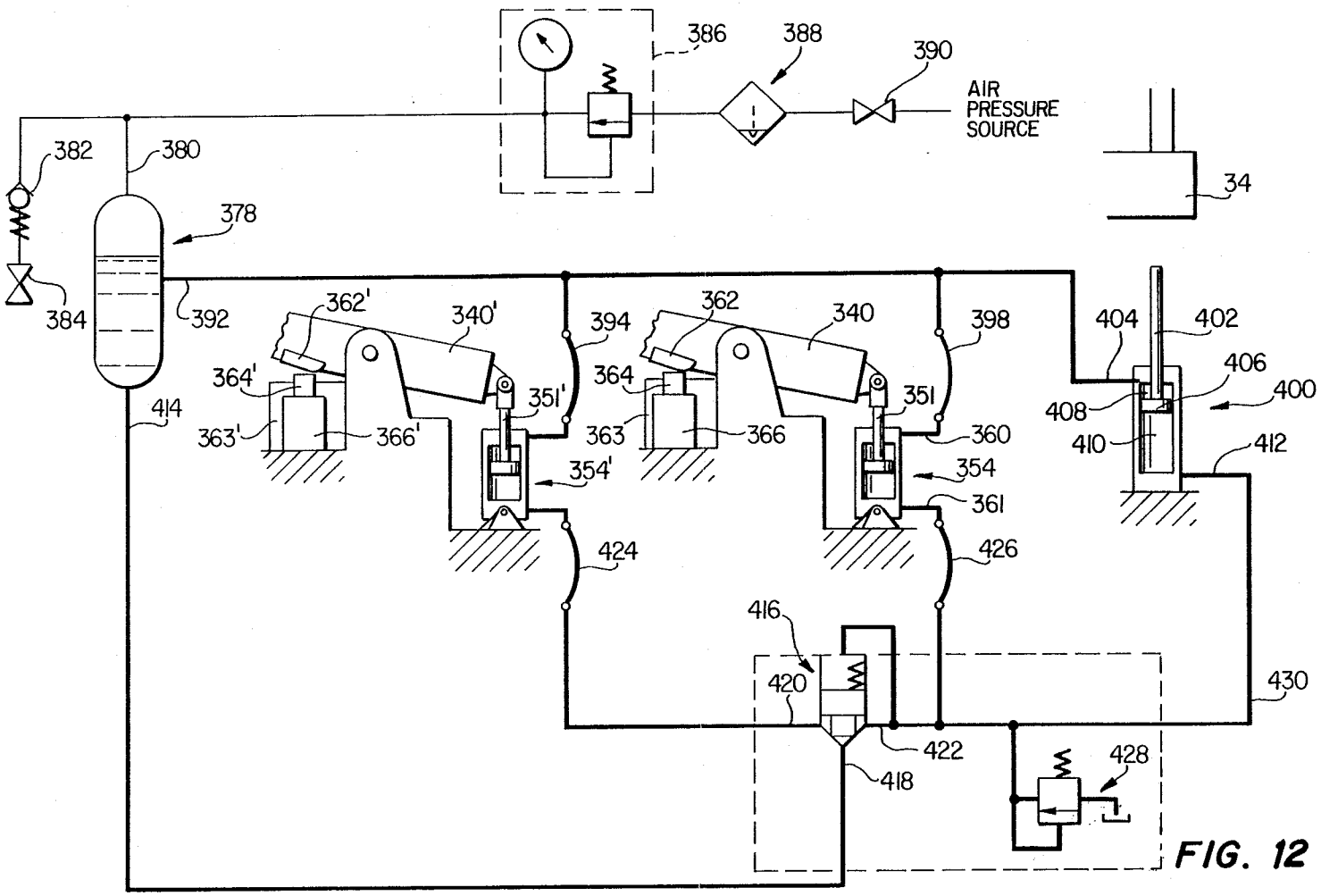
FIG. 12 illustrates in schematic form the hydraulic control system employed with the press slide to operate the emboss punch lever cylinder in a timed manner.

FIG. 12 schematically depicts the hydraulic system utilized to operate the levers of the draw/emboss station 18 and 22. The hydraulic system of the invention includes a fluid reservoir 378 partially filled with oil. The upper part of the reservoir 378 is pressurized with air. An inlet connection 380 of the reservoir 378 is connected by a line to an air-check valve 382 and blow-off valve 384. This assures that excessive pressure will not be built up in the fluid reservoir 378. The inlet connection 380 is also connected to a pressure regulator 386, and therethrough to a filter and water separator 388. On an inlet side of the filter and water separator 388, there is connected a gate valve 390 which is connected to a source of air pressure (not shown).

A first outlet 392 of the fluid reservoir 378 supplies fluid pressure by a first, hose 394 to the rod end of a a hydraulic cylinder 354'. The first outlet 392 of the reservoir 378 is also connected by another hose 398 to the rod end of the hydraulic cylinder 354. In the example, the hydraulic cylinder 354 is associated with the first draw/emboss station 18, while the hydraulic cylinder 354' is associated with the second draw/emboss station 22. The first reservior outlet 392 is also connected to the rod end of a slave hydraulic cylinder 400. The slave hydraulic cylinder 400 is of the type having a rod 402 which is forced within the cylinder 400 by the application of pressure to the rod end inlet 404. The rod 402 is connected to a plunger 406 which separates the cylinder 400 into a first chamber 408 and a second chamber 410. The second chamber 410 is filled with hydraulic fluid so that when the rod 402 is forced downwardly, hydraulic fluid in the chamber 410 is forced through a slave hydraulic cylinder outlet 412. The rod 402 of the slave hydraulic cylinder 400 is forced downwardly in response to the downward movement of the press slide 34.

A second outlet 414 of the fluid reservoir 378 is connected to a check-valve 416. The check-valve 416 is provided with an inlet port 418 by which pressurized fluid from the reservoir 378 can flow through the check-valve 416 and out a first outlet port 420 and a second outlet port 422. The first outlet port 420 is connected by a hydraulic hose 424 to the bottom side of the draw/emboss station hydraulic cylinder 354'. The second outlet port 422 is connected by a hydraulic hose 426 to the bottom side of the draw/emboss station hydraulic cylinder 354. The second outlet port 422 of the check-valve 416 is also connected to a relief valve 428. The relief valve 428 prevents excessive pressure from existing in the hydraulic line 430 connected between the second outlet port 422 of the check-valve 416 and the outlet 412 of the slave hydraulic cylinder 400.

The hydraulic system of FIG. 12 operates in the following manner. When the press slide 34 is at its uppermost position, there is little or no pressure applied to the rod 402 of the slave hydraulic cylinder 400. Therefore, the air pressure within the fluid reservoir 378 forces hydraulic fluid out of the first outlet 392 and the second outlet 414. These pressures are substantially identical, and are applied to the upper and lower ends of the hydraulic cylinders 354 and 354' as well as to the slave hydraulic cylinder 400. However, since there is less area on the rod side of each of the cylinders, than on the other side, the respective rods of the cylinders all tend to move upwardly. With the press slide 34 in its uppermost position, the rod 402 of the slave hydraulic cylinder is fully extended from the cylinder 400. This is not the case with the hydraulic cylinders 354 and 354', as the pressure in the gas cylinders 366 and 366' counteracts the pivotal movement of the respective levers 340 and 340' such that the levers do not move. As a result, the steady state position of the levers 340 and 340' is that shown in FIG. 12, i.e., pivoted in a fully clockwise direction.

As the press slide 34 begins its downward movement, as a result of a crank arm rotation (not shown), the rod 402 of slave hydraulic cylinder 400 begins to move downwardly. The check-valve 416 is then forced closed, thereby allowing hydraulic fluid forced out of slave hydraulic cylinder outlet 412 to supply high-pressure fluid to the lower connections of hydraulic cylinders 354 and 354'. In response to the increased hydraulic pressure in hoses 424 and 426, the hydraulic cylinder rods 351 and 351' begin their upward movement, thereby pivoting the levers 340 and 340' in a counterclockwise direction. The counterclockwise rotation of levers 340 and 340' overcomes the static pressure within the gas cylinder 366 and 366', thus allowing the respective cylinder rods 364 and 364' to be retracted within the cylinders. As a result of the counterclockwise pivotal movement of the levers 340 and 340', the emboss punch assemblies 86 are forced downwardly. As noted above, the downward movement of the emboss punch assembly 86 continues until the cup 14 is brought against the reduced diameter part of draw/emboss die 146 and 148.

When further counterclockwise pivotal movement of the levers 340 and 340' is halted due to the stalling of the hydraulic cylinder 354 or due to the resistance on the blocks 362 and 362', excessive pressure is built up within hydraulic line 430, whereupon the relief valve 428 allows hydraulic fluid to be redirected into the fluid reservoir 378 via a second valve outlet. The operation of the relief valve 428 in response to increased hydraulic pressure in line 430 allows hydraulic fluid to forced out of the slave hydraulic cylinder chamber 410 and relieved into the reservoir 378. Sufficient pressure yet exists in the hydraulic hoses 424 and 426 to maintain the cylinder pistons 351 and 351' in extended positions.

Once the levers 340 and 340' are pivoted counterclockwise to their stopped positions, the continued downward movement of the press slide 34 only causes a further transfer of hydraulic fluid from the slave hydraulic cylinder chamber 410 through the relief valve 428 to the fluid reservoir 378. However, when the press slide 34 begins its upward movement, hydraulic pressure in line 430 is reduced, whereupon check-valve 416 opens and the pressure in the fluid reservoir 378 forces hydraulic fluid into line 430, thereby causing the slave hydraulic cylinder piston rod 402 to begin moving upwardly. As noted above, the gas cylinders 366 and 366' overcome the pressure in hydraulic hoses 424 and 426 and thereby force the levers 340 and 340' in a clockwise direction. As a result, the emboss punch assembly 86 begins moving upwardly.

As can be appreciated from the hydraulic system of FIG. 12, the timed movement of the emboss punch assembly 86 and the pressure sleeve assembly 92 are the result of the movement of the press slide 34. However, due to the unique interaction between the emboss punch assembly 86 and the pressure sleeve assembly 92, the movements thereof are relatively independent, even though occasioned by the same power source, namely the press slide 34. It should be understood that those skilled in the art may devise other hydraulic systems, or electrical systems, for achieving the same timed sequence to operate the metal work stations.

Figure 13:
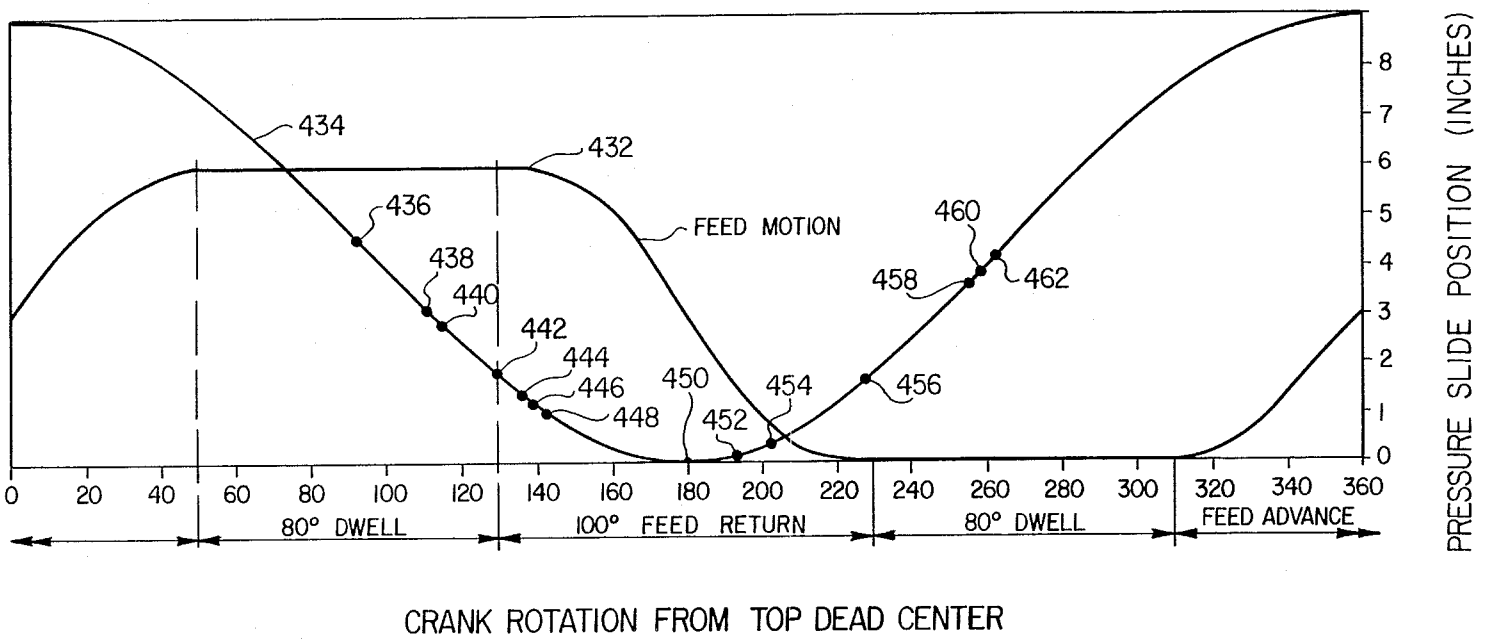
FIG. 13 graphically depicts the motion of the press slide with respect to that of the feed motion during one cycle of the combined draw and embossing step.

FIG. 13 graphically depicts the motion of the draw-/emboss station 18 through the various sequences of the drawing and embossing operation. The horizontal axis of the graph represents the crank arm rotation, 360° representing a full cycle of each work station. As noted above, the crank arm is connected to the press slide 34, and thus a full rotation of the crank arm produces a full downward and return stroke of the press slide 34. The vertical axis of the graph represents the relative position of the press slide 34 during a stroke from a reference point. The reference point is selected, for purposes of example, to be the lower-most position of the press slide in its downward stroke.

Line 432 is representative of the path taken by the feed motion. Line 434 represents the position of the press slide 34 during different parts of the stroke, or rotation of the crank arm. Particularly, the position 436 is where the press slide 34 is moving downwardly and contacts the slave hydraulic cylinder piston rod 402. The levers 340 and 340' begin rotating counterclockwise. At position 438, the pressure sleeve 130 engages the shoulder 84 of the cup 14. Reference character 440 indicates the position of the press slide 34 when the emboss punch head 96 enters the cup 14. 442 indicates the position of the press slide 34 when the emboss punch head 96 engages the bottom of the cup 14 and displaces the cup from the spring-loaded fingers 372 and 374. The cup 14 thus enters the mouth of the draw/emboss die 146.

Graphical location 444 indicates that the press slide 34 is yet moving downwardly, causing the levers 340 and 340' to be pivoted to a particularly stopped position, thus pinching the cup 14 between the end of the emboss punch head 96 and the internal reduced diameter area of the draw/emboss die 146. The annular opening between the end of the emboss punch head 96 and the draw/emboss die 146 is thus defined. Also, relief valve 428 is operated, wherein hydraulic fluid from the slave hydraulic cylinder 400 is forced into the fluid reservoir 378.

Reference character 446 represents the initial part of the drawing and embossing sequence where the pressure sleeve 130 begins forcing the cup 14 through the annular opening between the end of the emboss punch and the draw/emboss die. The drawing and embossing of the cup 14 occurs during the motion of the press slide 34 identified between reference characters 448 and 450. Reference character 448 identifies the press slide position where the emboss punch head 96 stops moving. The pressure sleeve 130 is forced downwardly in its stroke, thereby forcing the cup 14 through the annular opening.

Reference character 450 represents the bottom of the press slide stroke after the crank has rotated 180°. number 452 indicates the initial upward stroke of the press slide 34 which allows decompression of the slave hydraulic cylinder 400, thus allowing the gas cylinders 366 and 366' to force the respective levers 340 and 340' upwardly. The end of the emboss punch head 96 is retracted from the cup.

Point 454 on the graph of FIG. 13 indicates that part in the upward stroke of the press slide 34 where the pressure sleeve 130 begins its upward movement, after the retraction of the end of the emboss punch head 96 from the cup 14. Reference character 456 is where the lift-out apparatus is activated to lift the cup 14 out of the draw/emboss die 146. Point 458 indicates the upward stroke position of the press slide 34 where the emboss punch assembly 86 and the pressure sleeve assembly 92 halt upward movement in response to the full extension of the compressed gas cylinders 366 and 366'. Point 460 represents the press slide position wherein the emboss punch assembly 86 and the pressure sleeve assembly 92 have been moved upwardly further in response to the movement of the levers 340 and 340' occasioned by the hydraulic cylinders 354 and 354'. Lastly, 462 indicates the time in the crank rotation in which the cup 14 is removed from the the draw/emboss die 146, and into the transfer feed mechanism. 370, ready for transfer to the next work station.

From the foregoing, disclosed is a method and apparatus for forming a cup-shaped article and impressing a design on the inside surface thereof. Disclosed also is a multi-work station system for sequentially processing an article starting from planar sheet stock and ending with an embossed cup-shaped article. The sequential operations of the system comprising the forming, drawing and embossing steps are all synchronized and operate in a timed manner to provide an efficient and fast operating system.

A principal advantage of the method and apparatus of the invention is the transferring of an embossed pattern from a emboss punch die head to the inside surface of a cup-shaped article by locating the emboss punch in a close relationship with an emboss die, and forcing the cup through the space therebetween. As a result of the constriction of the cup sidewall material as it passes through the opening, the emboss design is transferred from the emboss punch to the surface of the cup. An additional advantage of the method and apparatus is that the emboss punch is mounted for rotational movements so that spiral-type embossing patterns can be utilized. When impressing spiral-type embossing designs on the surfaces of the cup-shaped article, the emboss punch head is allowed to freely rotate as the sidewall material of the article is forced between the emboss punch and the emboss die.

In accordance with another advantage of the invention, a pressure sleeve assembly is utilized as a mechanism for forcing the cup-shaped article through the annular opening defined by the space between the emboss punch and the emboss die. The emboss punch is mounted for reciprocating movement within the pressure sleeve, and moveable independently of the sleeve. Hence, the embossing operation can be carried out by inserting the emboss punch within the cup-shaped article and lowering the emboss punch and article into the emboss die a predetermined distance. When the desired spacing between the emboss punch and emboss die is achieved, the punch and die remain stationary, and the pressure sleeve is then engaged with a shoulder on the cup and applies a downward force to force the cup through the opening. The sidewalls of the cup-shaped article thus undergo a simultaneous draw and emboss operation. The emboss punch is then withdrawn from the cup, and thereafter the pressure sleeve is also withdrawn and moved to an initial retracted position. The embossed and drawn cup is then ready for movement to another metal forming work station.

Figure 14:
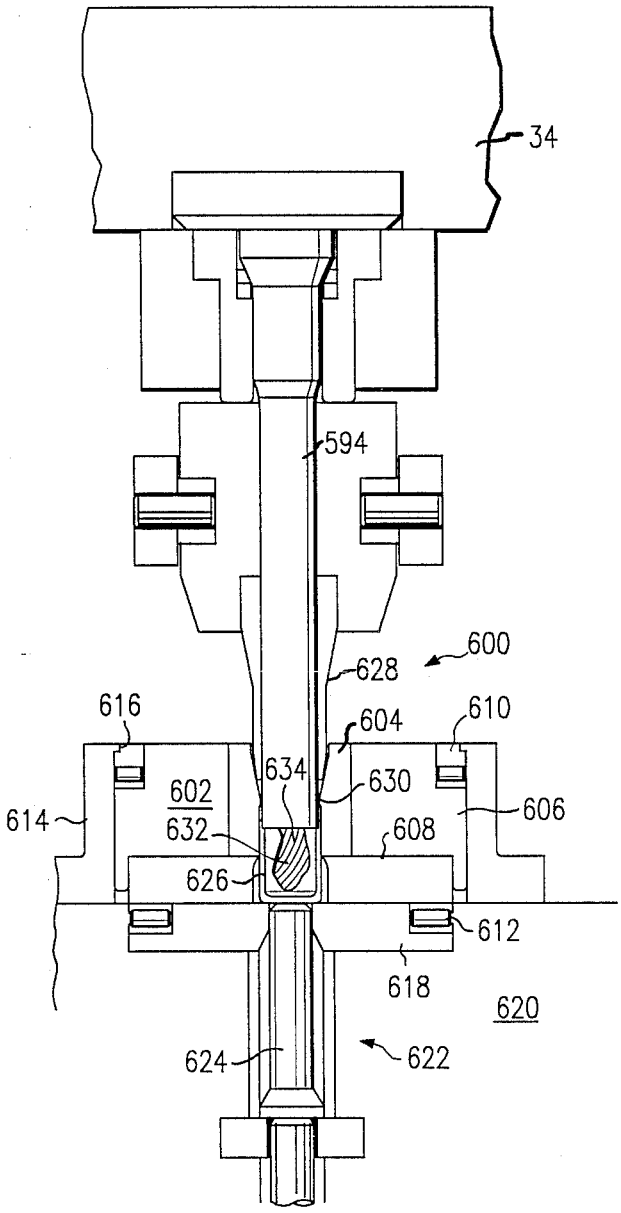
FIG. 14 is a cross-sectional view of an alternate embodiment of the invention.

FIG. 14 illustrates an alternative to the work station 18 or 22 as shown in FIG. 1*b* for embossing the inside surfaces of cup-shaped articles with spiral-type designs. The operation of work station 600 is essentially the same as depicted above in FIG. 1*b*, except that rotation of punch shaft 94 is no longer required. Rather, any desired rotation is carried out in this embodiment by the draw die assembly 602. The rotatable draw die assembly 602 includes a cylindrical draw die 604, a draw die holder 606 and a draw die anvil 608. Rotation of the draw die assembly 602 is provided by thrust bearings 610 and 612. Thrust bearing 612 provides rotation of the die assembly 602 during the embossing sequence, while thrust bearing 610 allows rotation of the assembly 602 during withdrawal of punch 594 therefrom. Bearing 610 is secured between the die holder 606 and a die housing 614 by an annular shoulder 616.

The thrust bearing 612 is secured between the draw die anvil 608 and a bearing plate 618. The bearing plate 618 is fitted into a bolster plate 620. The article lift-out equipment 622 including a lift-out shaft 624 perform the same functions as described above in FIG. 1*a* (items 66 and 70) and FIG. 1*b* (item 150).

The bearings 610 and 612 are preferably tapered antifriction thrust bearings. It is to be understood, however, that the bearings 610 and 612 may be of any other suitable type.

Rotation of the die holder 606 in relation to the fixed die housing 614 is allowed due to a running clearance (not shown) between the two adjoining surfaces therebetween. This running clearance may also be lubricated with oil, grease or any other suitable substance.

The downward rotational force on the draw die 604 can thus be seen to be taken by the thrust bearing 612 during the embossing sequence The force exerted by the cup-shaped article 626 on the draw die 604 is the result of the punch sleeve 628 pushing on the top end of the article 626 and forcing such article 626 through the constricted annular area 630 of the draw die 604 and the embossing head 632. The spiral embossing design 634 on the punch head 632 causes the cup 626 to rotate somewhat with respect to the nonrotatable punch shaft 594. In the alternate embodiment of the invention, the draw die 604 and its associated assembly 602 is allowed to rotate with the cup 626.

When the embossing punch 594 is withdrawn from the die assembly 602, the cup tends to follow the punch head 632. By the apparatus described above, the punch sleeve 628 remains stationary while the punch shaft 594 is raised, thus removing the cup 626 from the punch head 632. As the cup is being removed from the punch head 632, it again rotates with respect to the punch head 632. The upward rotational force resulting from the withdrawal of the punch 594 is taken by the thrust bearing 610. The shoulder 616 on the die housing prevents upward movement of the draw die assembly 602. Thus, the draw die assembly 602 is free to rotate during both cycles of the embossing sequence.

Although not shown, it is possible that one skilled in the art could choose to allow the punch 594 to retain its rotational ability as shown above in FIG. 1*b*, and simultaneously allow rotation of the draw die 596.

While the preferred embodiment of the method and apparatus of the invention have been disclosed with reference to particular emboss punch and pressure sleeve apparatus, it is to be understood that many changes in detail may be made as a matter of engineering choices without departing from the spirit and scope of the invention as defined by the appended claims. Indeed, those skilled in the art may prefer to embody the apparatus using electrical or mechanical equipment, rather than hydraulic equipment, and in light of the foregoing description, the adaption will be facilitated. Also, it is not necessary to adopt all of the various advantages or features of the present disclosure into a single composite system in order to realize the individual advantages. For example, with the teachings of the foregoing, those skilled in the art may find that an article can be embossed on an outside surface thereof by placing a design on the reduced diameter part of the die. For spiral designs, the emboss die with the emboss design can be made to rotate within bearings, while the punch remains nonrotatable.

What is claimed is:

1. Embossing apparatus for embossing a spiral design on the interior of a cup, comprising:

die means including fixed die housing means, a rotatable die holder located in said housing means, a rotatable annular anvil supporting said die holder, a die having an opening and a reduced diameter part defining an annular protuberance on an interior surface thereof, located for rotation with said holder and supported by said anvil, an upper thrust bearing located between said holder and housing means and a lower thrust bearing located between said anvil and said housing means;

an embossing punch having a spiral-type embossing design on that exterior thereof and having an outside diameter somewhat smaller than the inside diameter of said reduced diameter part, and moveable for at least partial insertion into said opening proximate said reduced diameter part;

sleeve means engageable with said cup for forcing said cup between said punch and said protuberance of said die to effect said embossing;

means for positioning said punch with respect to said reduced diameter part of said die and for operating said sleeve means for forcing said cup between said punch and said protuberance of said die;

lift out means carried by said housing means and including a moveable lift out haft sized to project upwardly through said die after said cup has been embossed to force said cup out of the opening in said die;

said lower thrust bearing supporting the downwardly directed load exerted during embossing of said cup to permit rotation of said die during embossing; and said upper thrust bearing supporting the upwardly directed force exerted during removal of said punch from said cup and removal of said cup from said die and to permit rotation of said die during removal of the embossing punch from the cup.

* * * * *